US005836862A

United States Patent [19]

Granger

[11] Patent Number: 5,836,862

[45] Date of Patent: Nov. 17, 1998

[54] FOLDED AND UNFOLDED PAPER TOWEL DISPENSING APPARATUS

[76] Inventor: Maurice Granger, 17 rue Marcel Pagnol, 42270 Saint Priest En Jarez, France

[21] Appl. No.: 702,694

[22] PCT Filed: Mar. 27, 1995

[86] PCT No.: PCT/FR95/00378

§ 371 Date: Sep. 6, 1996

§ 102(e) Date: Sep. 6, 1996

[87] PCT Pub. No.: WO95/26157

PCT Pub. Date: Oct. 5, 1995

[30] Foreign Application Priority Data

| | | | |
|---|---|---|---|
| Mar. 28, 1994 | [FR] | France | 94/04399 |
| Apr. 26, 1994 | [FR] | France | 94/05698 |
| May 27, 1994 | [FR] | France | 94/06907 |

[51] Int. Cl.[6] ..... B65H 19/06

[52] U.S. Cl. ..... 493/459; 312/34.1; 312/34.19

[58] Field of Search ..... 493/416, 438, 493/439, 440, 405, 352, 356, 359, 360, 410, 424, 434, 436, 442, 443, 444–447, 454, 455, 458, 459, 468; 312/34.1, 34.8, 34.19, 34.24, 245

[56] References Cited

U.S. PATENT DOCUMENTS

| | | | |
|---|---|---|---|
| 2,360,973 | 10/1944 | Pedersen | 493/346 |
| 2,369,851 | 2/1945 | Price et al. | 312/34.19 X |
| 3,294,460 | 12/1966 | Wooster et al. | 312/34.19 |
| 3,628,743 | 12/1971 | Bastian | 312/34.22 X |
| 4,065,028 | 12/1977 | Merila | 221/36 |
| 4,338,086 | 7/1982 | Heater | 493/458 X |
| 4,756,485 | 7/1988 | Bastian et al. | 312/34.22 X |
| 4,765,555 | 8/1988 | Gambino | 312/34.22 X |
| 4,811,878 | 3/1989 | Horirchi | 225/46 |
| 4,944,466 | 7/1990 | Jespersen | 312/34.22 X |
| 5,294,192 | 3/1994 | Omdoll et al. | 312/34.22 X |

*Primary Examiner*—Joseph J. Hail, III
*Assistant Examiner*—Anthony O'Jini
*Attorney, Agent, or Firm*—Wall Marjama Bilinski & Burr

[57] ABSTRACT

A paper dispenser includes a housing having a controlled-stroke hinged device mounted onto a reel-holder. A protective housing cover features longitudinal ribs fitting the stroke hinged device such that, when the cover is closed and the stroke-hinged device lowered in position, an extending paper length the user pulls on is folded with the long ends partly under the paper band being fed out by the upper contact of the stroke hinged device so that it may be introduced folded between the drum and a tensioning device, be severed by a paper-cutoff device, folded, and then be pulled out as a folded napkin or towel by the user. Alternately, and when the stroke hinged device is moved into a raised position relative to the reel-holder and an assembly consisting of the drum and the tensioning device, the paper is fed unfolded between the drum and the tensioning device, to be severed by the cutoff device when pulled onto by the user.

32 Claims, 20 Drawing Sheets

FOLDED AND UNFOLDED PAPER TOWEL DISPENSING APPARATUS

BACKGROUND OF THE INVENTION

The invention relates to the technical sector of apparatus dispensing cellulose wadding, creped paper towels and towels of similar materials, especially those used for wiping the user's hands, toilet paper and paper napkins.

Apparatus with automatic cutoff devices dispensing hand-towels where the potential user seizes the paper band to obtain a length of paper for the usage referred to, thereby actuating a given operating cycle are commercially available.

Applicant himself has developed numerous paper dispensing apparatuses, and notably those described in French patent applications 9304082 and 9314609.

In these apparatuses, the paper band is cut across its entire unfolded width, thus retaining its original width. One of the original aspects of the dispensers described in the patents referred to earlier is its design, which, requiring only a reduced number of parts, allows rapid field installation with no special tools.

SUMMARY OF THE INVENTION

Summarily, the apparatus comprises a housing featuring lateral flanges formed such as to permit the rapid installation of a drum, its associated cutoff device and a tensioning device pressing down onto the drum, both parts locking in position automatically when pressed home and causing the paper band fed from a reel located in the upper housing to be tightened.

Applicant, within the general framework of his research into paper dispensing apparatuses has likewise developed an apparatus dispensing zigzag fold hand-towels, as notably described in French patent 2 632 292. This particular design uses sectional plates integral with the cover to prepare the paper band on the one hand and an additional appropriate twisting device locked onto the housing folding the length of paper pulled by the user and feeding it into a cassette-like device comprising reels mounted facing one another that, at a given moment, can cut the band folded into several plies to ensure its distribution in given lengths using an appropriate cutoff device. Folding the paper, it should be remembered, is useful only in case of thin, easily torn material requiring a minimum of three plies.

Such an apparatus will operate quite well in principle, but its manufacturing cost is high, especially because of the cutoff device.

Indeed, costs would cause the apparatus, though operationally perfectly reliable, to be priced out of the market.

Confronted with the problem, applicant has designed a simplified dispenser of folded paper bands with an automatic cutoff device.

Another problem was that up till now, the various automatic dispensers of folded or unfolded paper bands were of dissimilar design, requiring considerable investment in tooling to manufacture apparatus for each specific function.

Applicant's objective thus became the design of a basic apparatus capable of dispensing both folded and unfolded paper bands for multiple applications requiring a minimum of tooling changes, hence a minimum of investment, especially in moulds.

As a result of incompatible technologies, the combined contents of applicant's patents were in themselves insufficient to constitute an apparatus capable of performing the differing functions required.

Taking into account the requirements mentioned, applicant has designed an apparatus to dispense paper, cellulose wadding and similar materials and especially recycled paper used for napkins, hand-towels and toilet paper.

The benefit of the apparatus specified is its reduced number of parts, viz., a protective housing, a cover, a drum with an integrated cutoff device, a tensioning device, reel-holder device integral with the housing and a protective reel and reel drive belt as required, all such parts being made in plastic and described in French patents N 93.04082 and 93.14609 and to be mounted in a special way, the original aspect being the addition of a retractable device for preparing and feeding out the paper band folded or not, depending on the application.

Consequently, a single apparatus comprising seven or nine parts at most will, depending on whether the protective reel and the drive belt are used or not, perform either function, resulting in manufacturing cost savings, especially as regards the number of moulds to be made.

The paper dispenser specified herein features complementary arrangements forming a single piece with the moulded major parts, allowing the apparatus to be matched to the application.

According to a first aspect, the paper dispenser is of a type featuring lateral flanges inside the upper part of the housing to support a reel of material and, inside the lower part, a drum designed to be fitted with a cutoff device, a tensioning device pressing onto said drum, with the paper path running between said drum and cutoff device, which is hinge-mounted relative to the drum to ensure the paper length pulled out by the user is cut according to a cycle that is determined by drum rotation and including the means to start and reverse the drum as well as a hinged cover located at the bottom of the housing and clicked in place with a locking device, said apparatus being remarkable in that a controlled-stroke hinged device is mounted onto the reel-holder device and in that the cover features longitudinal ribs fitting said device such, that when the cover is closed and the device lowered in position, the length of paper the user pulls on is folded with the long ends partly under the band fed out by the upper contact of the device so that it may be introduced folded between the drum and the tensioning device, be severed by the cutoff device folded and be pulled out as a folded napkin or towel by the user, and in that said hinged device, when moved into the raised position relative to the reel-holder device and the assembly consisting of the drum and the tensioning device, will allow the paper to be fed unfolded between the drum and the tensioning device to be severed by the cutoff device when pulled onto by the user.

Another object sought after according to the invention was therefore to produce a new arrangement of the flanges of the housing between which the reel of wipe material is placed to allow easy fitting and to ensure that the reel of material is self-locking.

Therefore, according to a further aspect, the reel-holder device is hinged relative to upper flanges of the housing, said flanges being made with a circular opening and a concentric spacer ring and means of limit stopping and guiding, and in that reel-holder device is made in the form of a U-shaped arch of which the lateral arms surround the outside of the upper flanges of the housing, and in that said lateral sides have end pieces capable of fitting in the circular openings and spacer rings on the flanges of the housing, and in that the movement of lowering or raising the arch makes it possible to retract said end pieces or allow their offset inside the volume defined between the flanges in order to allow their insertion and self-locking in position of the reel of material, and in that the sides of the arch and the lateral flanges are designed with means that allow displacement of said end pieces by relative modification of the position of the lateral arms (with respect to the upper flanges of the housing).

Another aim of the present invention was to improve the locking system of the cover on the housing in order to ensure the complete protection of the various mechanisms referred to above.

Therefore, according to another aspect, the cover is fitted, on its front internal surface, with two locking means designed to cooperate with means arranged on the connecting plate of the arch, enabling the cover to be locked and unlocked in position relative to the apparatus' housing.

BRIEF DESCRIPTION OF THE DRAWINGS

These aspects and others will become apparent from the following description.

The object of the present invention is described, merely by way of example, in the accompanying drawings in which.

DESCRIPTION OF THE INVENTION

Figure 1:
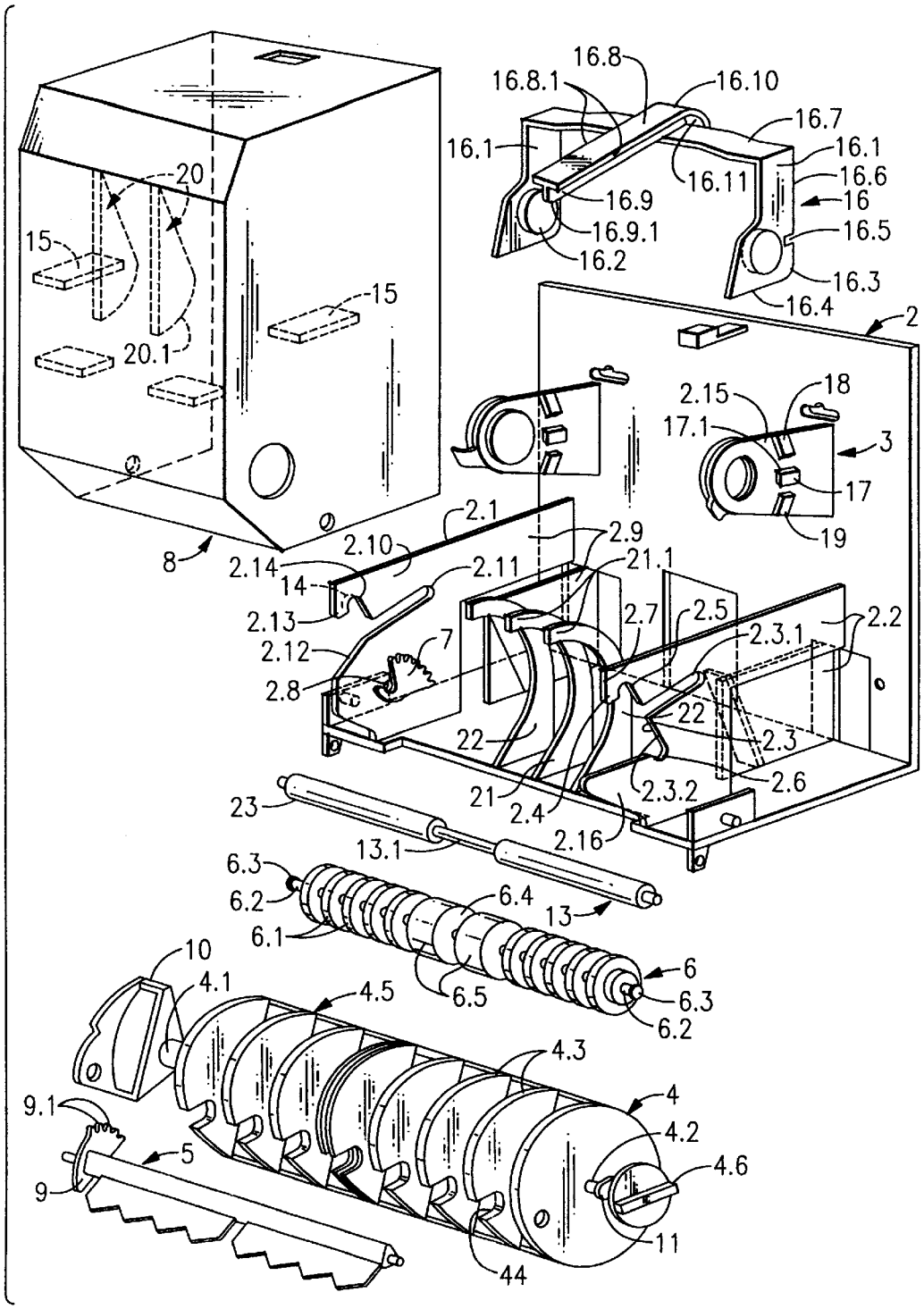
FIG. 1 is a perspective view prior to the component parts of the paper dispenser described being installed.
Figure 2:
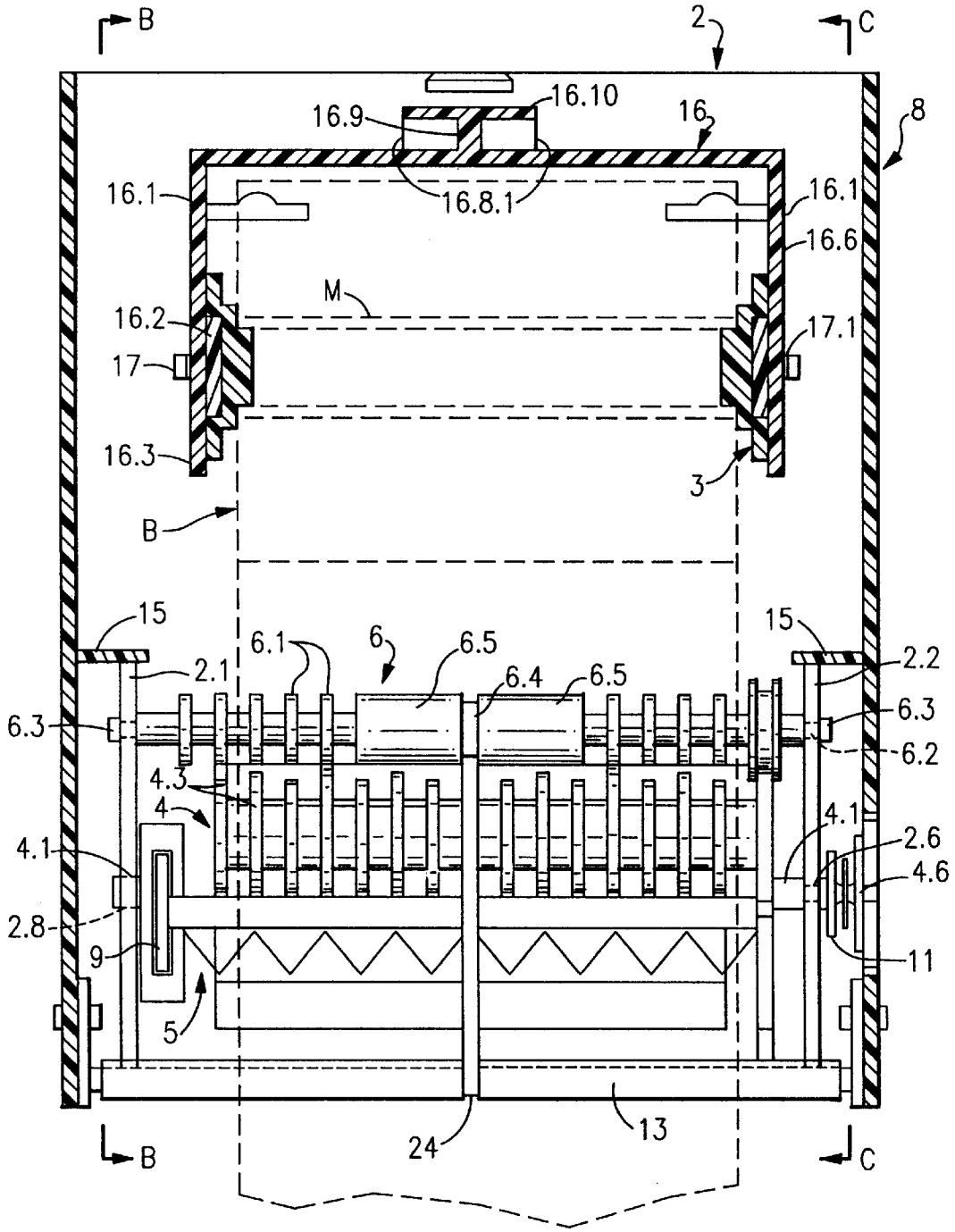
FIG. 2 is a front sectional view of the apparatus along line AA of FIG. 3 and with the cover removed showing the paper path when the unit is used in an unfolded towel or toilet paper application.
Figure 3:
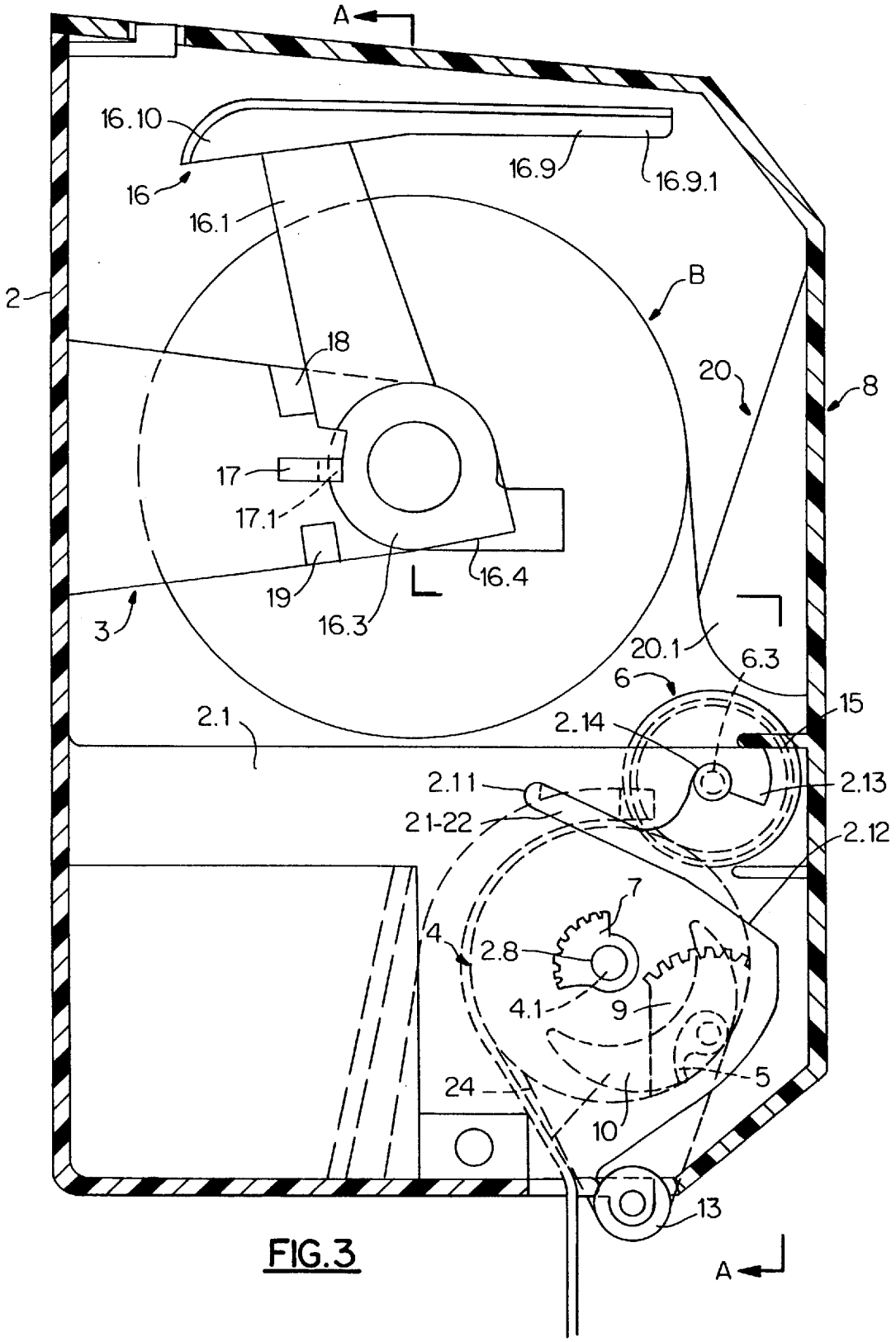
FIG. 3 is a side sectional view along line BB of FIG. 2.
Figure 4:
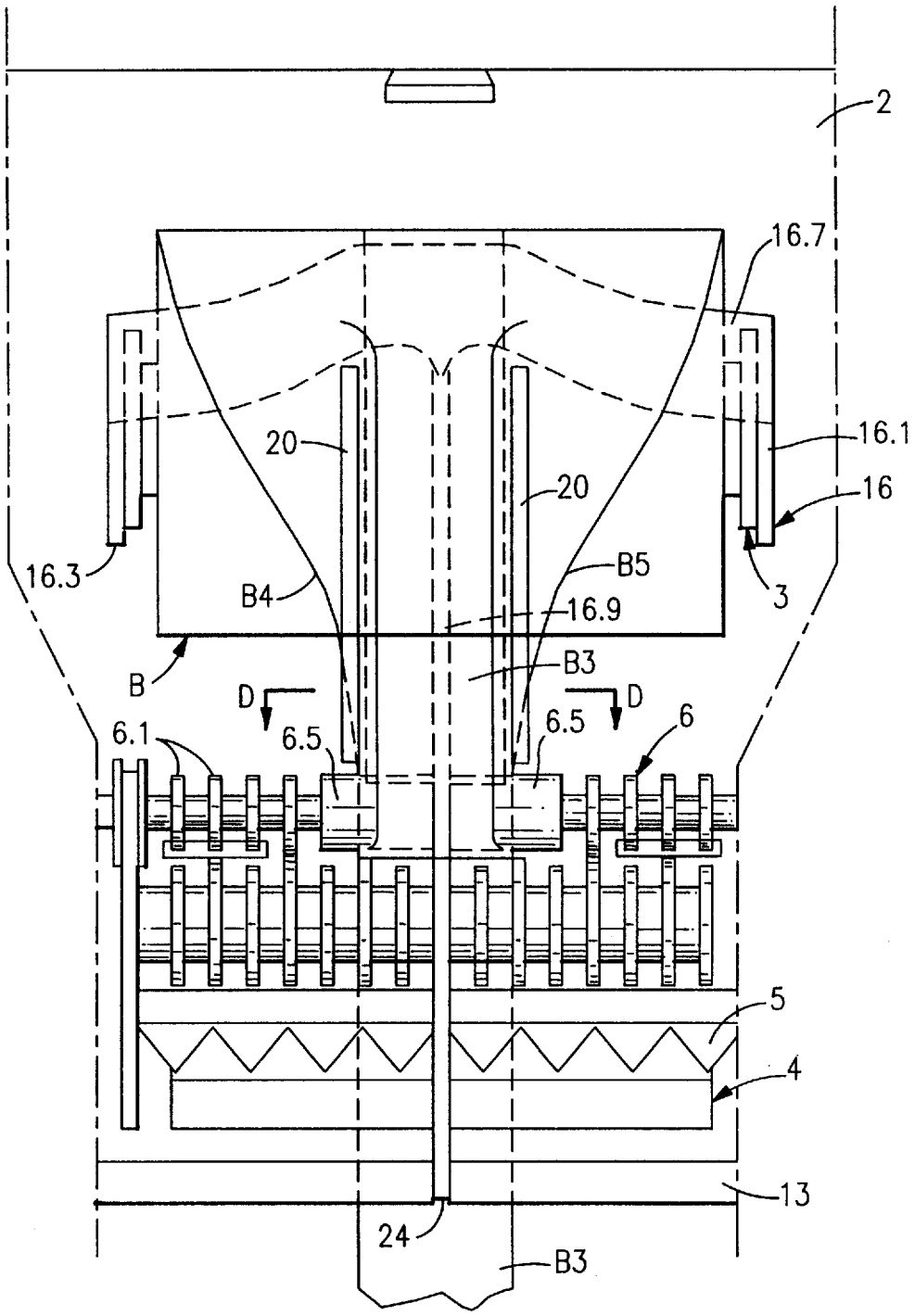
FIG. 4 is a partial front view showing the location of the paper folding device when the unit is used in its paper napkin version.
Figure 5:
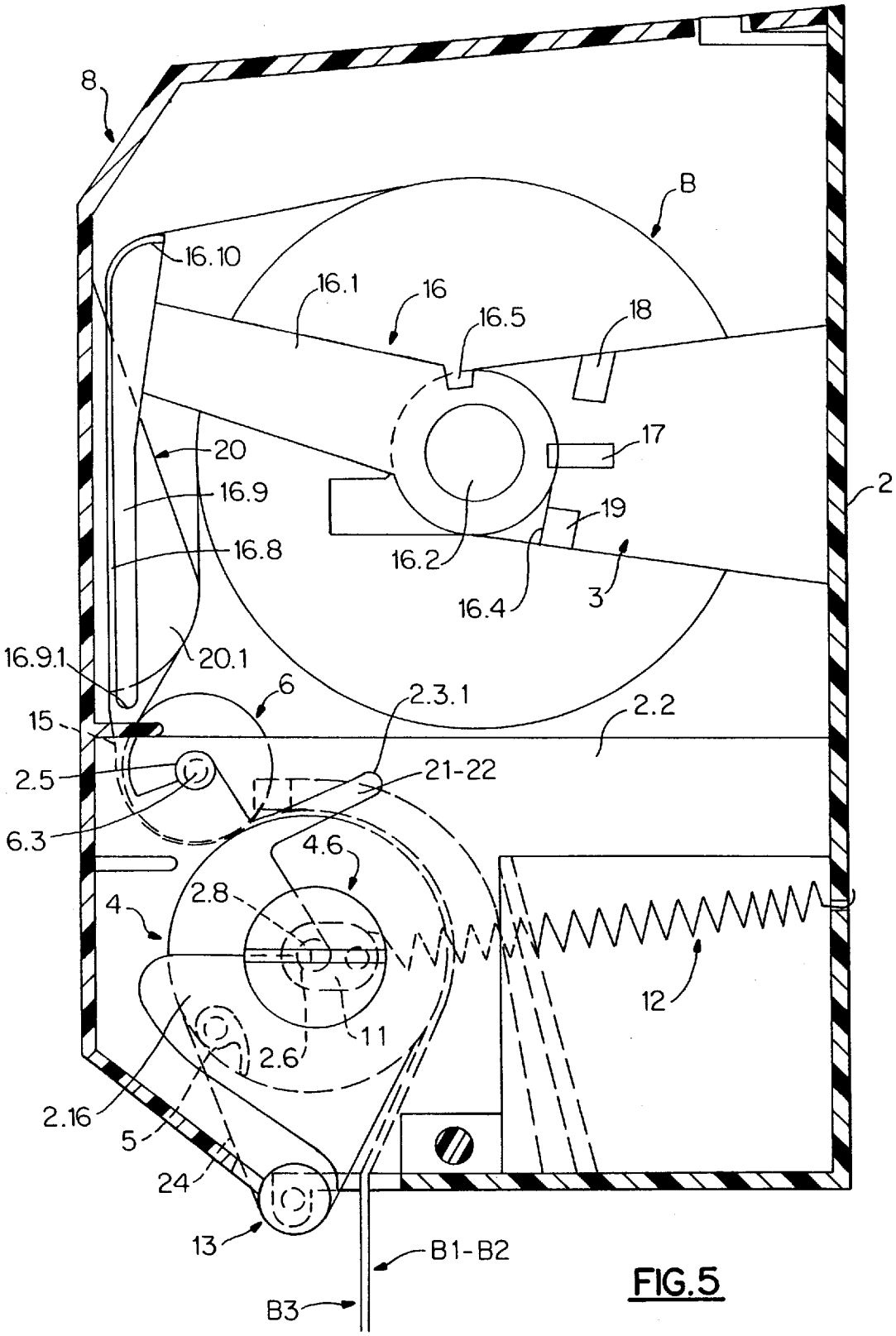
FIG. 5 is a sectional view along line CC of FIG. 2, the unit being used for dispensing paper napkins in the arrangement illustrated in FIG. 4.

In order that the present invention may be more readily understood, the following description is given, merely by way of example, reference being made to the accompanying drawings.

According to the specifications, this invention is an automatic dispenser of hand-towels, toilet paper or folded lengths of paper such as napkins.

The complete apparatus is shown in (1). It requires six or eight components or mechanisms in all to operate as a hand-towel or a toilet paper dispenser, i.e. a moulded plastic housing (2) with moulded reel-holder device (3), a cover (8), a drum (4), a paper cutoff device (5), a tensioning device (6), means for actuating and reversing (12) the drum and, where necessary, a protective reel (13) and a drive belt (24). In particular, the apparatus comprises a moulded plastic housing (2) the upper part of which is designed to receive a reel-holder device (3) for a reel (B) of towel, toilet or napkin paper, a drum (4) with a paper cutoff device (5) and a tensioning device (6) for feeding the paper band (B) to the drum on the one hand and taking up the slack of the paper band on the other. The movement of the knife towards the drum to cut the paper band is obtained by a moulded rack-type device (7) mounted on the inside of and onto one of the sides (2.1) of the housing (2). The cutoff device (5) can be moved using the mechanisms and arrangements described in French patents N. 93.04082 and 93.14609. A protective cover (8) protects the mechanisms referred to and the paper band to be dispensed. The protective cover is located at and hinges on the base of the housing of the apparatus and is clicked in place to close using a locking tongue located in the upper part of the housing.

The drum, which can be of the type described in French patents N. 93.04082 and 93.14609 referred to above, comprises a shaft (4.1) of reduced diameter onto which are mounted several disks (4.3) which are both adjacent and parallel, featuring a profiled notch (4.4) for receiving the cutoff device (5). The rack device (7) integral with one of the housing walls in line with the drum shaft can engage a cam-shaped part (9) with multiple teeth (9.1) associated with the knife shaft, the combined action of the cam part and the rack (7) moving the knife out of the drum under the conditions described in the French patents referred to.

Figure 10:
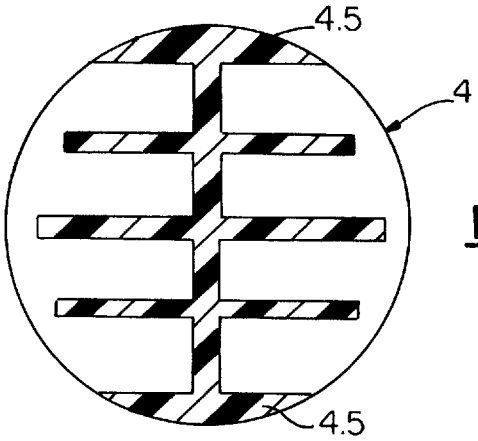
FIG. 10 is a schematic diagram of the drum onto which the cutoff device is fitted.

The cutoff device (5) consisting of a knife and a knife holder is centered in notches or recesses formed between one of the drum end flanges and a part (10) acting as a segment at the other end of the drum facing the rack device (7). The shape and dimensions of the drum as well as the location of the intermediate disks may be of any suitable type. The visible drum parts can be equipped with gripping areas (4.5) to guide and transport the paper band. These areas may consist of rubber strips moulded onto the drum and located on both sides of the cutoff device in areas diametrically opposite, as shown by way of example in FIG. 10. The drum is a single piece.

On the other side of the rack (7) the drum shaft (4.2) extends beyond the end disk and is equipped with an eccentric lever (11) accommodating a drum release spring (12), the arrangement being part of the drum unit and the shaft ending in a loading button (4.6).

The tensioning device (6) resting upon the drum and, notably, onto the end and intermediate disks, is also equipped on its whole length with several disks (6.1) resting upon the mating parts of the drum. This device (6) is centered and hinges between the lateral flanges (2.1–2.2) formed onto the housing. The device (6) is also a single piece. A protective reel (13), located in the lower part of the apparatus, facilitates the handling of the lengths of paper cut off and is driven by the belt and the drum.

Each of the lateral flanges is made in a particular manner to allow the drum and the tensioning device to be clicked in place, using the resilience of said flanges. Moreover, the flanges are shaped such as to permit the drum and the tensioning device to self-lock in place after installation.

Indeed, in a preferred but not limitative embodiment, when facing the apparatus, one perceives the right-hand side flange (2.2) located next to the drum actuating mechanism to possess a profiled, T-shaped oblique cutout (2.3) with the leg (2.3.1) of the T upside down and pointing to the rear of the flange being very long. The bar (2.3.2) of the T is such that its ends enter into the upper part of the flange, the leg being a long tongue (2.4) in the shape of a hook. The upper and lower T-bar ends have rounded internal recesses (2.5) to hold one of the tensioning device ends. The lower part of the head of the T-bar is shaped as a rounded notch (2.6) in which one of the drum shaft ends is located. The flange front is recessed as shown in (2.16) for accessing, passing and installing the tensioning device (6) and the drum (4). The leg (2.3.1) of the T-shaped cutout gives the upper tongue a certain resilience, allowing the tensioning device (6) and the drum (4) to be installed. The upper tongue with the hooked tip (2.7) acts as an access ramp to the notched area designed to hold the tensioning device shaft (6).

The other flange (2.1), located on the left-hand side when facing the apparatus, features an area designed to locate the rack (7) and an opening (2.8) allowing one of the drum shafts to be passed. The rack is built around said opening. The side thus features a solid part (2.9) with a tongue (2.10) extending upward, the latter being separated from the solid part by a slot (2.11), lending said tongue a certain resilience. The slot (2.11) referred to is located in exactly the same plane and angle as the leg (2.3.1) of the T-shaped cutout of the opposite flange. Flange (2.1) is cut open (2.12) at the front for access to the slot (2.11) defining the tongue, the shape of that tongue being similar to that of the tongue described earlier, i.e., featuring a hooked tip (2.13) and an end recess (2.14) in which the other end of the tensioning device is located. The flange end recesses (2.5–2.14) can, where necessary, be fit with complementary equipment (14) to hold the tensioning device ends, and, above all, to prevent damage or wear of the bottom part of the flanges due to handling the tensioning device.

The tensioning device comprises at its ends a groove (6.2) to fit said recesses, whereas the tensioning device shaft end features shoulders (6.3) designed to rest upon the outer flange walls and the tongues in particular.

The housing, in addition, features horizontal support angles (15) for both ends of the tensioning device to rest on, securing the device regardless of paper band tension.

Thus embodied, the apparatus essentially operates as an automatic dispenser of unfolded paper towels and toilet paper.

The original aspect of the apparatus described resides in a complementary part (16) used to fold the paper band prior to its being fed out. The device (16), when installed hinged onto the reel-holder device (3), can be used in a special position to allow the paper band to be fed through and be folded according to a special pattern prior to being run between the tensioning device (6) and the drum (4), the rotation of the latter actuating the cutoff device (5), completely severing the folded paper band, thus dispensing a paper napkin. The device is raised into position when the apparatus operates as a dispenser of unfolded paper hand-towels or toilet paper.

Referring to the accompanying drawings, it can be seen that the device (16) is a plastic U-shaped arch with two lateral sides (16.1) designed to be installed on the outside of the flanges (2.15) supporting the reel of material (B), the inside of each side featuring a sleeve (16.2) to fit the spindle (M) of the reel of material. This sleeve (16.2) is either an integral part of the device or loose parts to be fitted to the sides (16.1) referred to above.

The end parts of said flanges covering the reel-holder device have rounded corners (16.3) continuing in straight edges (16.4) the function of which will be detailed farther on.

In addition, they advantageously feature a notch (16.5) in the vertical rear edge of each side between the rounded corners (16.3) and the points (16.6) at which the two sides are linked by the connecting plate (16.7). This notch (16.5) fits a hook (17) formed on the outer part of the reel-holder device flanges (2.15) with an opening (17.1) into which the device (16), when fitted to the device, will pivot in a locked condition, unless the notch (16.5) and the hook (17) are engaged for removing the device (16).

The upper (18) and lower (19) stops on the outside of the reel-holder device are designed to limit the stroke of the pivoting device. With the device in the raised position, the upper edges of its flanges are arrested by upper stop (18), whereas the lower straight edges (16.4) of its sides are arrested by lower stops (19).

The device features a long, profiled arm (16.8) in the middle with a flat top, which, when the device pivots, comes to rest on the side of the tensioning device (6).

The lower part of the arm features a central rib (16.9), the end (16.9.1) of which fits into the central slot (6.4) formed into the tensioning device (6).

The upper edge (16.10) of the crosswise connecting plate (16.7) of device (16) is rounded, allowing the paper band to be prepared and folded.

The arm curves in and down (16.11) to join the crosswise connecting plate to facilitate the unreeling of the paper band on the one hand and to lift the band over the crosswise connecting plate on the other, rendering folding possible. The arm, therefore, projects outward from the crosswise connecting plate.

Its offset position confers a certain spring and flexibility to the arm (16.8), favouring paper transfer.

To fold the paper band, the centre of the inside cover (8) features long extruded ribs (20) advantageously matching the length of the arm of device (16). Advantageously, the ribs and the cover are a single moulded part.

When the cover (8) swings up to close, the two ribs (20) come to rest on either side of the longitudinal edges (16.8.1) of the arm (16.8) of device (16), initiating the first folding operation and feeding the paper out to the tensioning device (6).

These ribs (20) facing the tensioning device have advantageously rounded edges (20.1) to smoothly guide the paper band towards its prefolding position and the tensioning device.

In a very advantageous manner, the middle part of the tensioning device (6) features two smooth areas (6.5) of appropriate length replacing the intermediate disks pressing down onto the folded paper band. This causes the band to be shaped into either of the configurations shown in FIGS. 7 and 8, where the long sides (B1–B2) of the paper band (B) are partly folded under its upper part (B3), which is fed along the top of the arm (16.8) described. The height (H) of the ribs at their widest point, i.e. near the rounded parts should be greater than the width (L1) of fold-in sides (B4–B5) for a proper fold. Thus, and by way of example, the top of the fold (B3) would be 6 cm across and the sides folded in (B4–B5) 3 cm.

We shall now proceed to explain the operation of the folded paper version of the dispensing apparatus, with device (16) swung forward and locked into position by the stops (19) and the middle rib of the arm fitting into the middle slot of the tensioning device.

Figure 6:
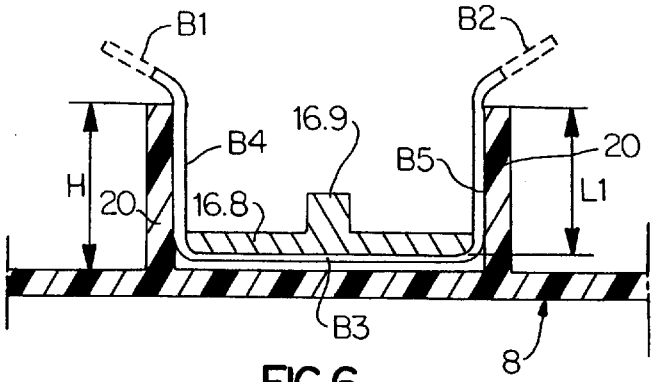
FIG. 6 is a partial sectional view of the paper folding device along line DD of FIG. 4.
Figure 7:
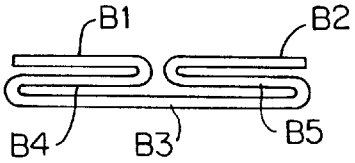
FIGS. 7 and 8 illustrate two embodiments of different paper folds.
Figure 8:
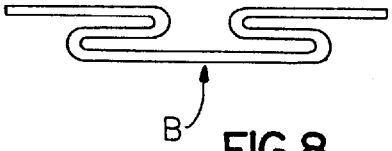
Figure 9:
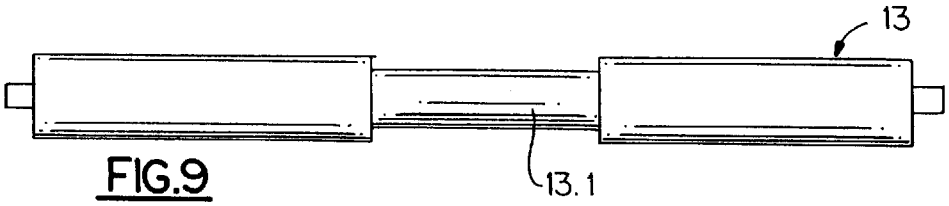
FIG. 9 shows the design of the protective reel located in the lower part of the housing.
Figure 12:
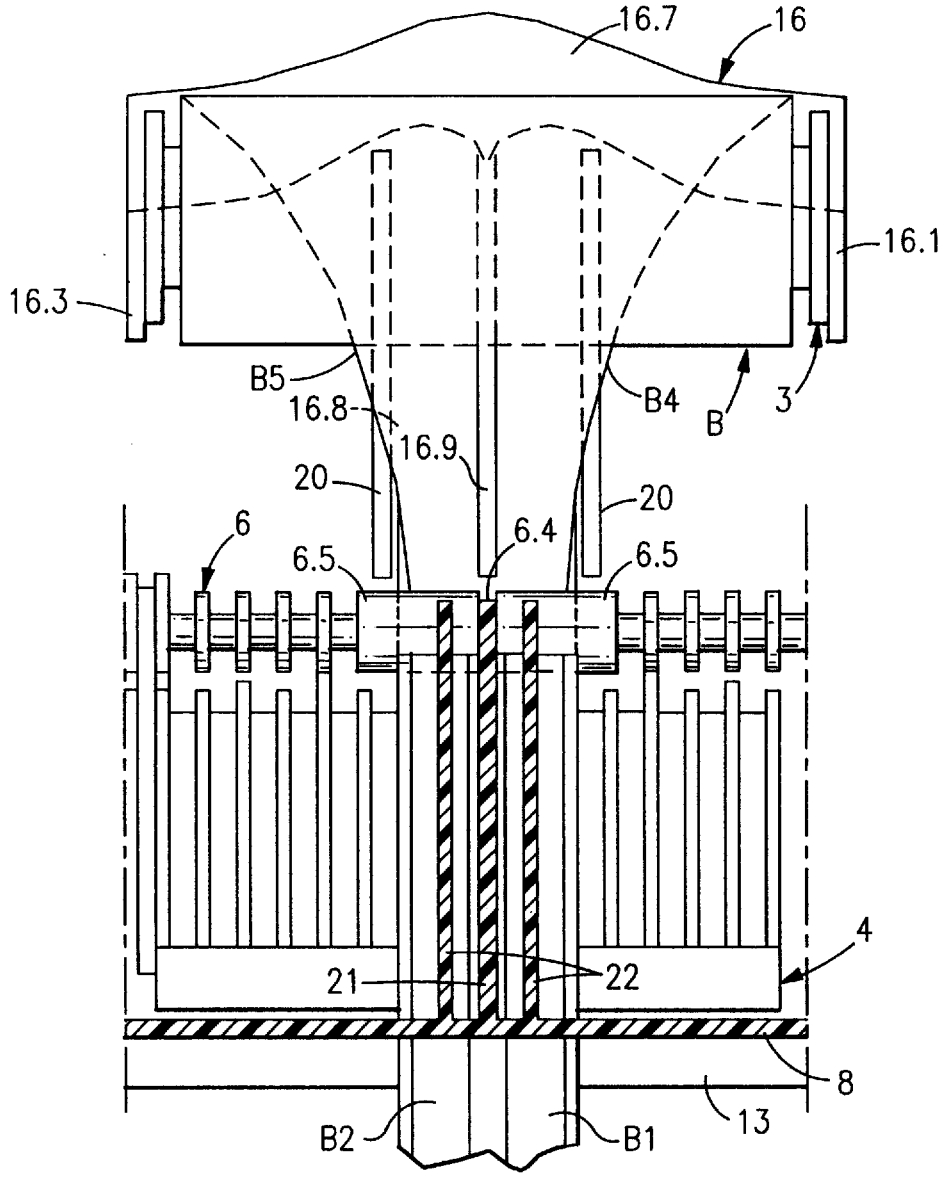
FIG. 12 is a rear view of the apparatus showing the paper path from unreeling through folding.
Figure 13:
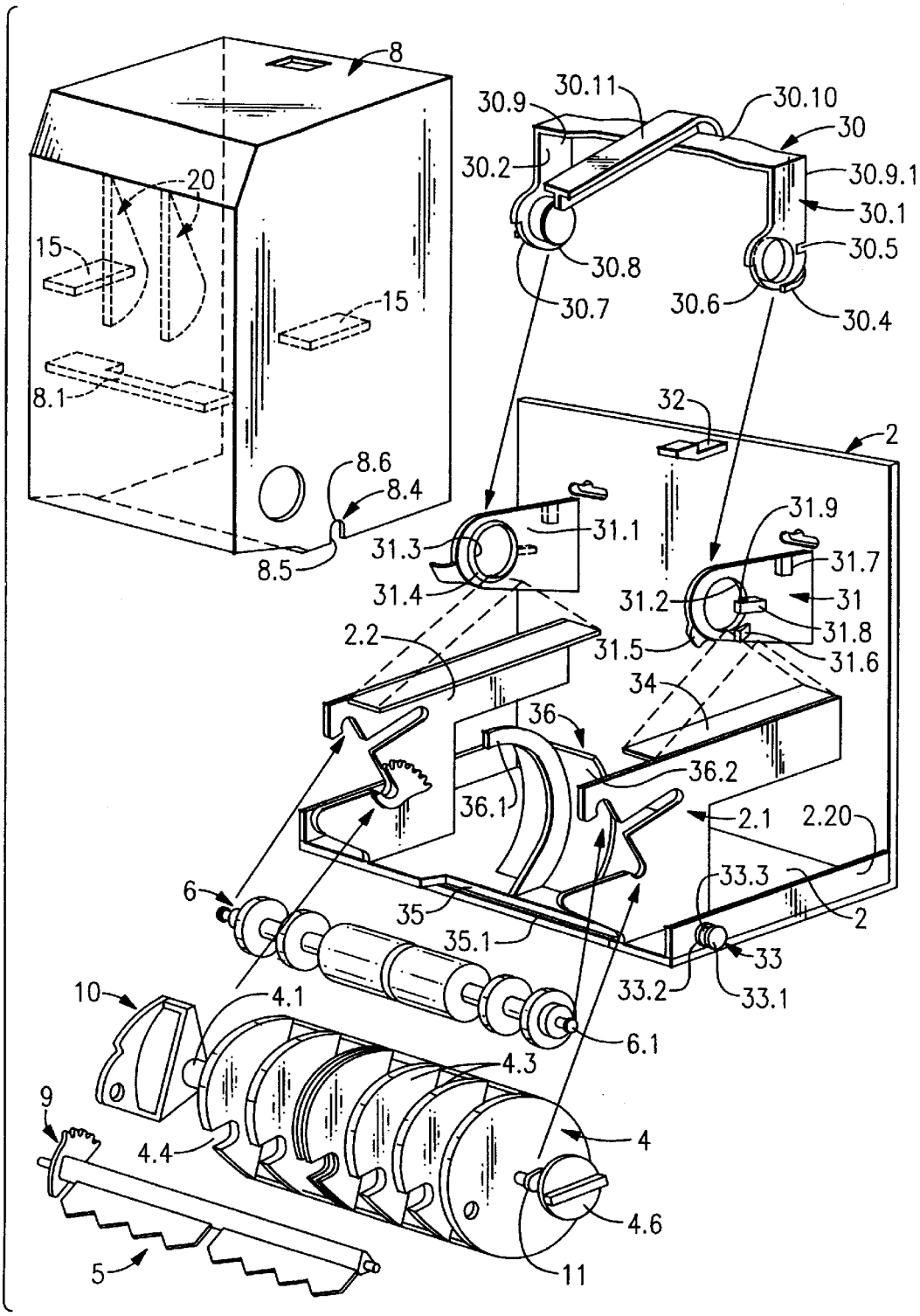
FIG. 13 is a perspective drawing before assembly of the apparatus' components according to the invention including the reel installation device.

The first operating cycle consists in unreeling the paper band and feeding it through the device (16) until it arrives in front of the tensioning device and the drum. Closing the cover will cause the ribs (20) to fold the paper band according to the pattern shown in FIG. 6, which, as shown in the drawings, causes the paper band to be narrowed. The paper band, gradually unreeling because of the rotating drum, will be fed through the channel formed by the arm (16.8) and the ribs (20) of the cover, causing the two lower folds (B1–B2) and the folds (B4–B5) to be formed near the tensioning device as shown in FIGS. 7, 8 and 12. The folded paper band is thus fed back into the apparatus between the tensioning device and the drum, with a cutoff device of the type described earlier cutting off a length of paper to be used as a napkin.

The dimensional ratios of the folded napkin and its folded-in sides (B1–B2) may vary as a function of requirements, arm length and rib height.

If said sides (B1–B2) are substantially wider than the top (B3) of the napkin, it will be easy to open.

To ensure proper guidance of the folded paper band, the system includes a bow (21) the upper end (21.1) of which enters into the central rib of the tensioning device, thus preventing any angular movement of the band.

Complementary bows (22) located on both sides of the main bow ensure correct feedout of paper at the end of the dispensing cycle.

A protective reel (23) can be added to the lower part of the apparatus, to be driven by the drum (4) using a belt (24). This protective reel, installed between the flanges of the housing, advantageously features a centre slot (23.1) the width of which matches that of the paper napkin.

The apparatus as described above will dispense napkins of appropriate lengths.

Figure 11:
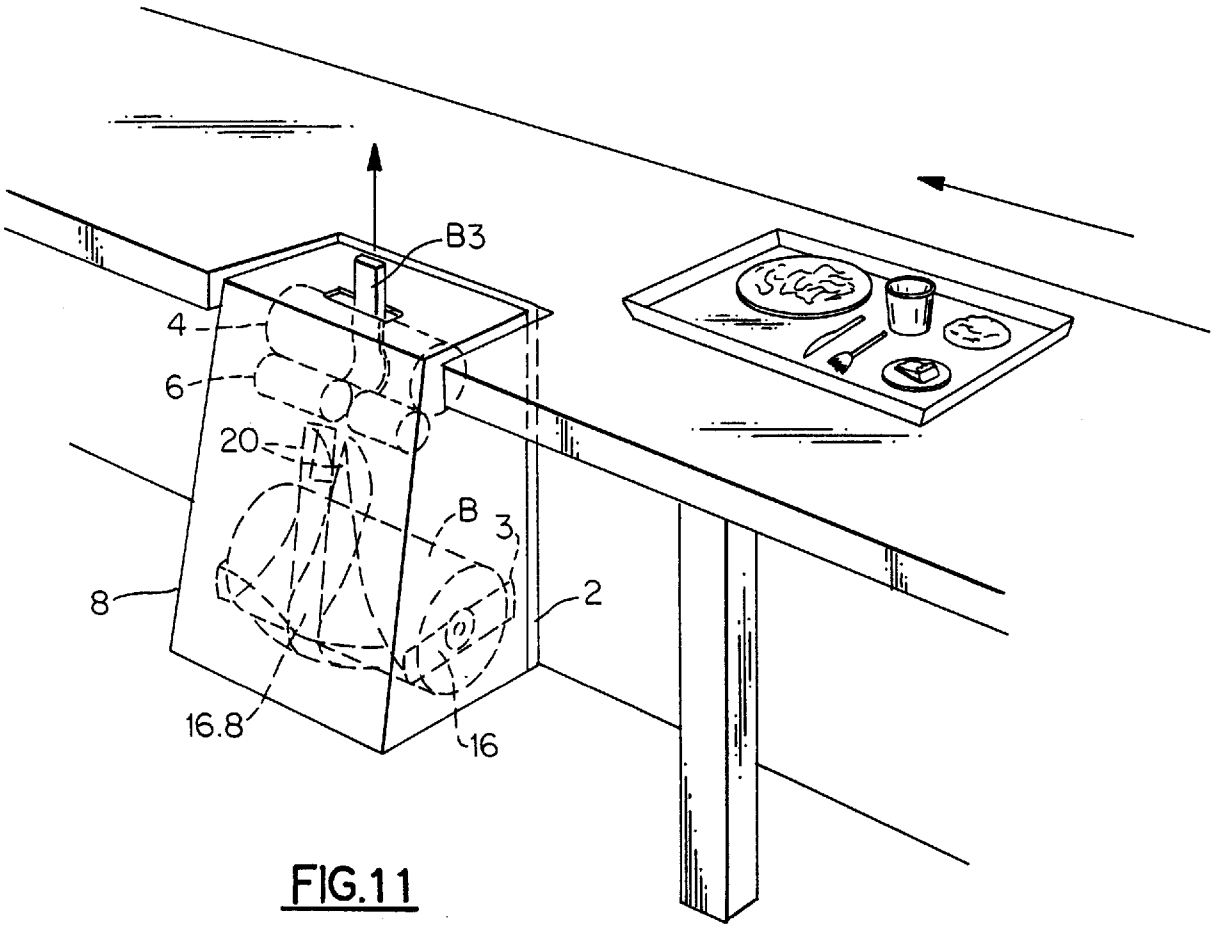
FIG. 11 is a sketch showing a food counter application of the paper towel dispenser.

FIG. 11 shows the apparatus in a food counter application.

In this embodiment, the dispenser is either fastened to the counter using any appropriate means, or, being tall, it can be placed on the floor. It is suitable for large-diameter paper rolls, dispensing paper napkins from the upper part for greater user comfort.

In this embodiment, the arm and the ribs on the cover are of a length such as to ensure proper guidance and folding of the paper band by forming a channel.

The apparatus invented is advantageous in that it can be made to perform two functions, viz., dispensing unfolded hand-towels and toilet paper and dispensing folded napkins using a reel of material and the same components.

Changing functions only requires locking the device (16) in either the raised or the lowered position.

It should be noted that, when the arm is in the raised position, the specific, rounded forms of the ribs in the cover contribute to tightening the paper band, also in the standard hand-towel version. In that case, the device (16) is raised out of the paper path. The apparatus thus comprises seven or at most nine component parts from a manufacturing and installation point of view if the protective reel and the drive belt are included, each of which can be moulded to different specifications.

Reference will now be made to the reel's installation device as shown in FIGS. 13 to 19.

According to a first original feature of the invention, there is a reel-holder device (30) that is hinged relative to the upper flanges (31) of the housing and allowing, depending on whether it is positioned in a raised or lowered position, securing and self-locking of the reel of material (B).

This device can advantageously be designed to function as a dispenser of strips of material in the unfolded position or in the folded position.

More particularly, this device is made in the form of a U-shaped arch (30) of which the lateral arms (30.1, 30.2) surround the outside of the upper flanges (31) of the housing of the apparatus. Said flanges (31) are made at the time of moulding with a front shape (31.1) having a circular opening (31.2) extending internally by a concentric spacer ring (31.3) having towards its periphery a flared face (31.4). This flared face preferably adjusts itself to the internal profile of the lateral side concerned, thus allowing insertion of the reel of material without catching or obstruction. The lateral walls of the flanges which are normal to the rear wall of the housing extend forward each with a flared tab (31.5) pointing towards the outside of the apparatus. On the outside surface of the flanges, moulding also produces a cam (31.6) designed with a ramp shape being arranged in the lower part of the flange near the above-mentioned circular opening (31.2). In the upper part of the flange and on the same side there is an angularly directed limit stop (31.7) to allow positioning of the arch in the raised position. Between cam (31.6) forming a ramp and limit stop (31.7) there is a premoulded hook shape (31.8) which constitutes a means of locking the arch after it has been positioned. This hook shape has an internal recess (31.9) which allows free passage and hinging of certain parts of the sides of the arch.

Parallely, said arch has on its lateral sides (30.1) and internally, premoulded end pieces (30.3) of a diameter such that they fit in the circular openings (31.2) made in the flanges of the housing. The ends of said sides are designed with a bulge (30.4) capable of adapting and positioning itself in the hook shapes (31.8) of the flanges during certain operating and positioning phases of the arch. In addition, at the ends of the sides of the arch there is rectangular scalloping (30.5) that can be aligned opposite the above-mentioned hook shapes in order to allow removal of the arch. In a position that is essentially diametral to said rectangular scalloping formed in the side of the arch there is a recess (30.6) over a limited angular sector around the periphery of the side of the arch so as to define a limit-stop surface (30.7) that can come into contact with the ramp shape (31.6) made on the upper lateral flanges of the housing.

Figure 14:
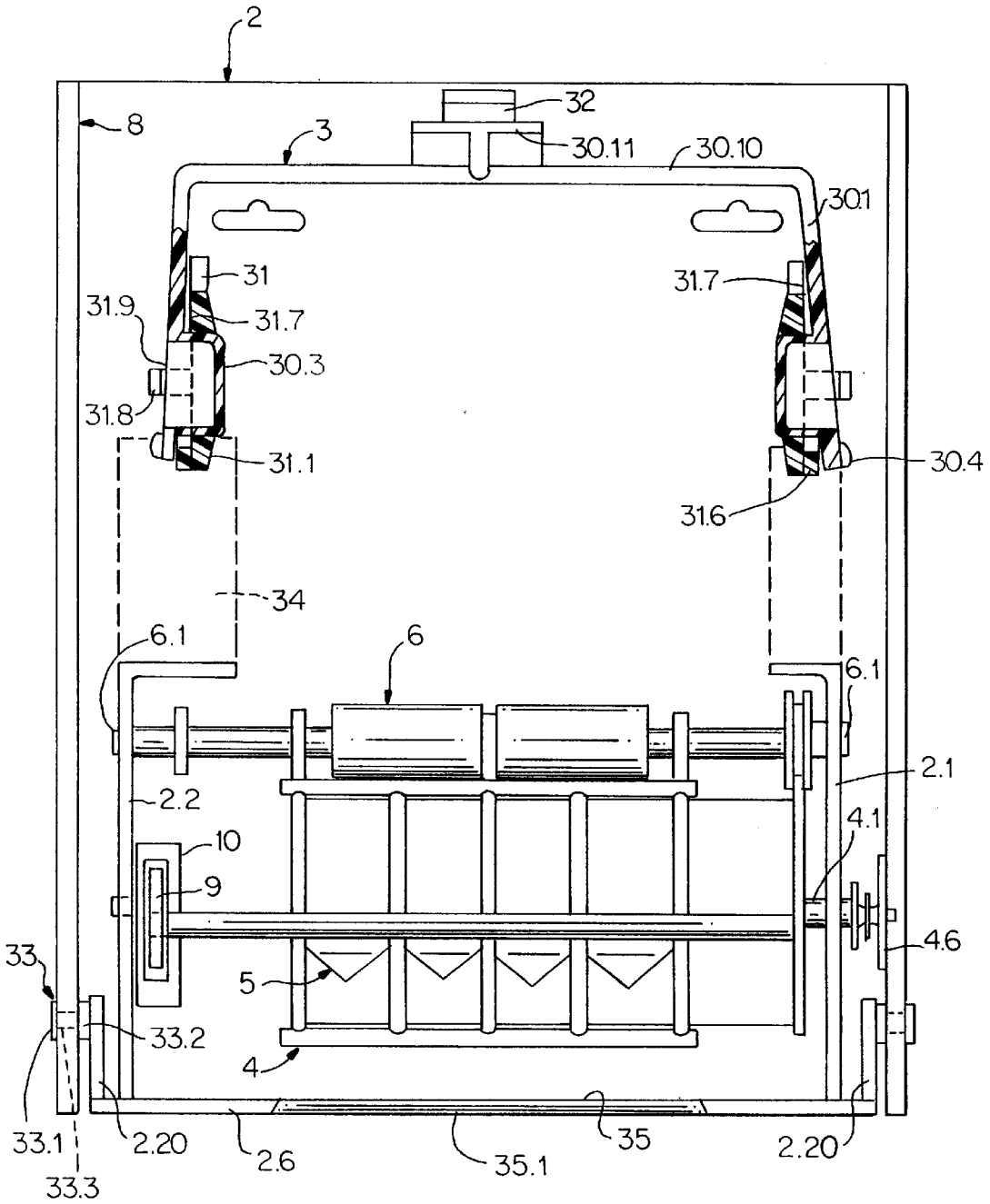
FIG. 14 is a front view of the apparatus according to FIG. 13, showing the position of the components before the reel of material is loaded.
Figure 15:
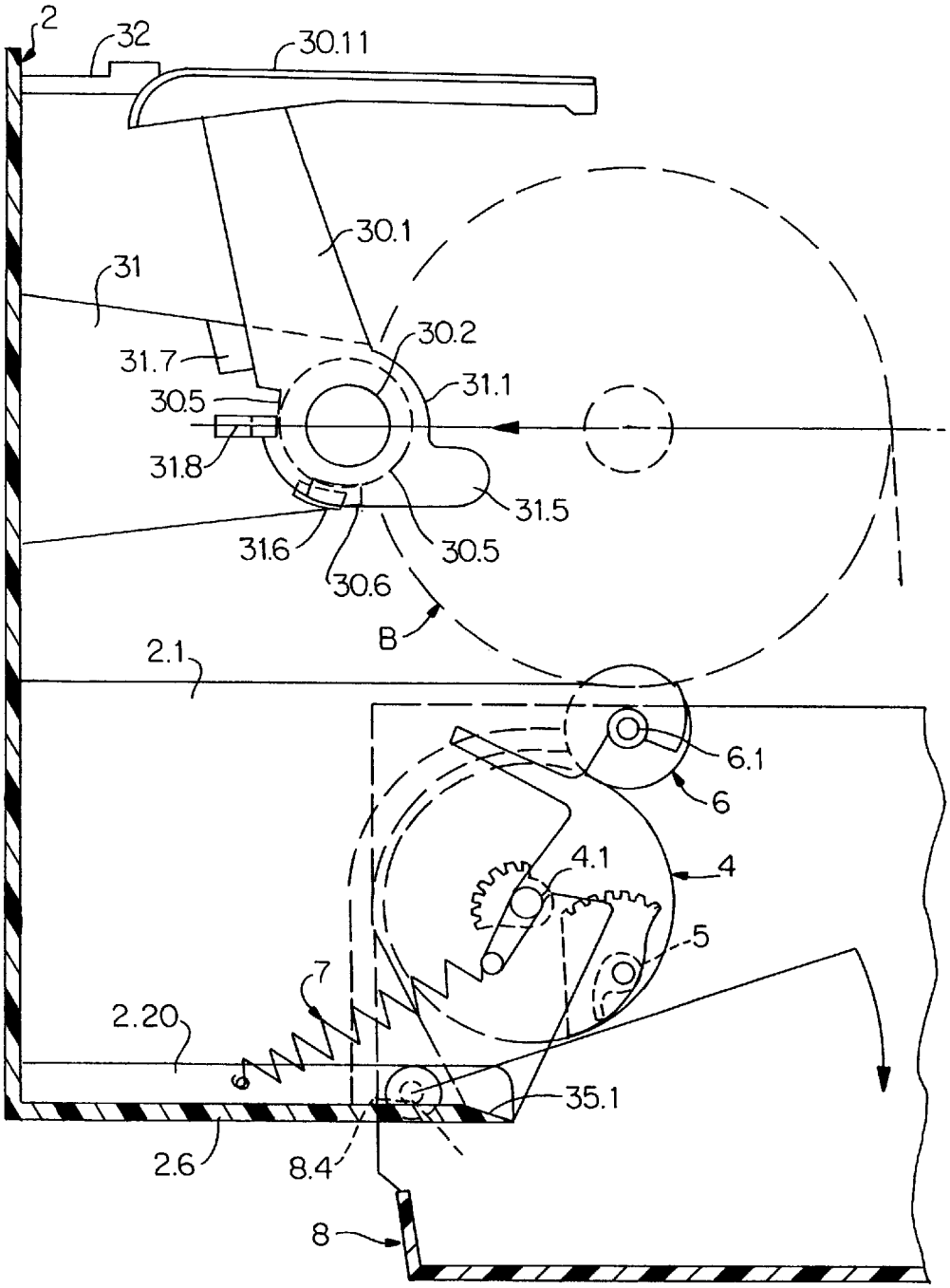
FIG. 15 is a side-face view of FIG. 14 giving a detailed view of the reel of material.
Figure 16:
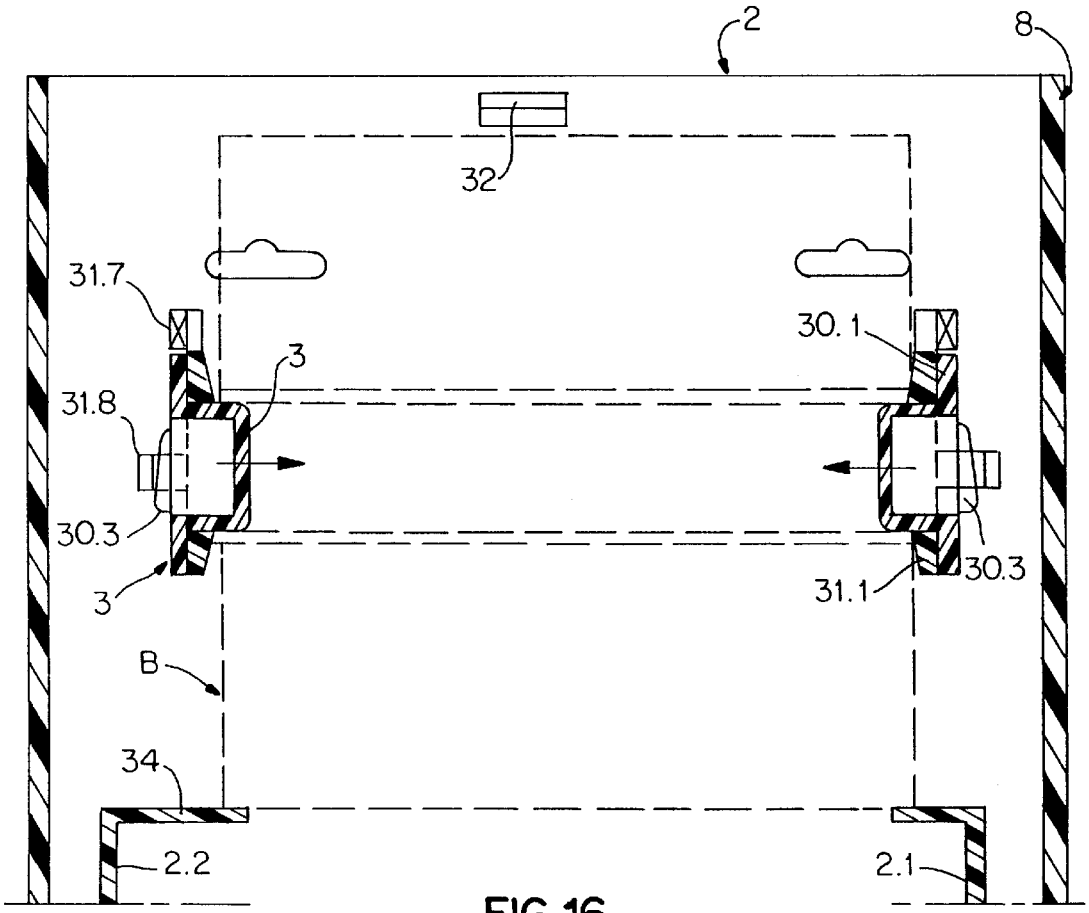
FIG. 16 is a partial view of FIG. 14 showing the position of the reel of material between the flanges after it has been installed and locked into position.
Figure 18:
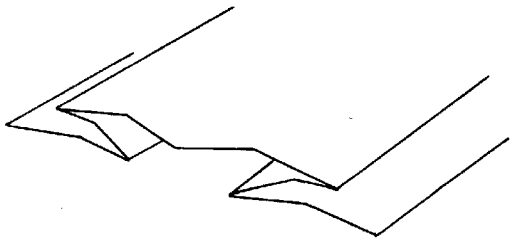
FIG. 18 is a view of the folded paper band obtained when the apparatus is operated.
Figure 17:
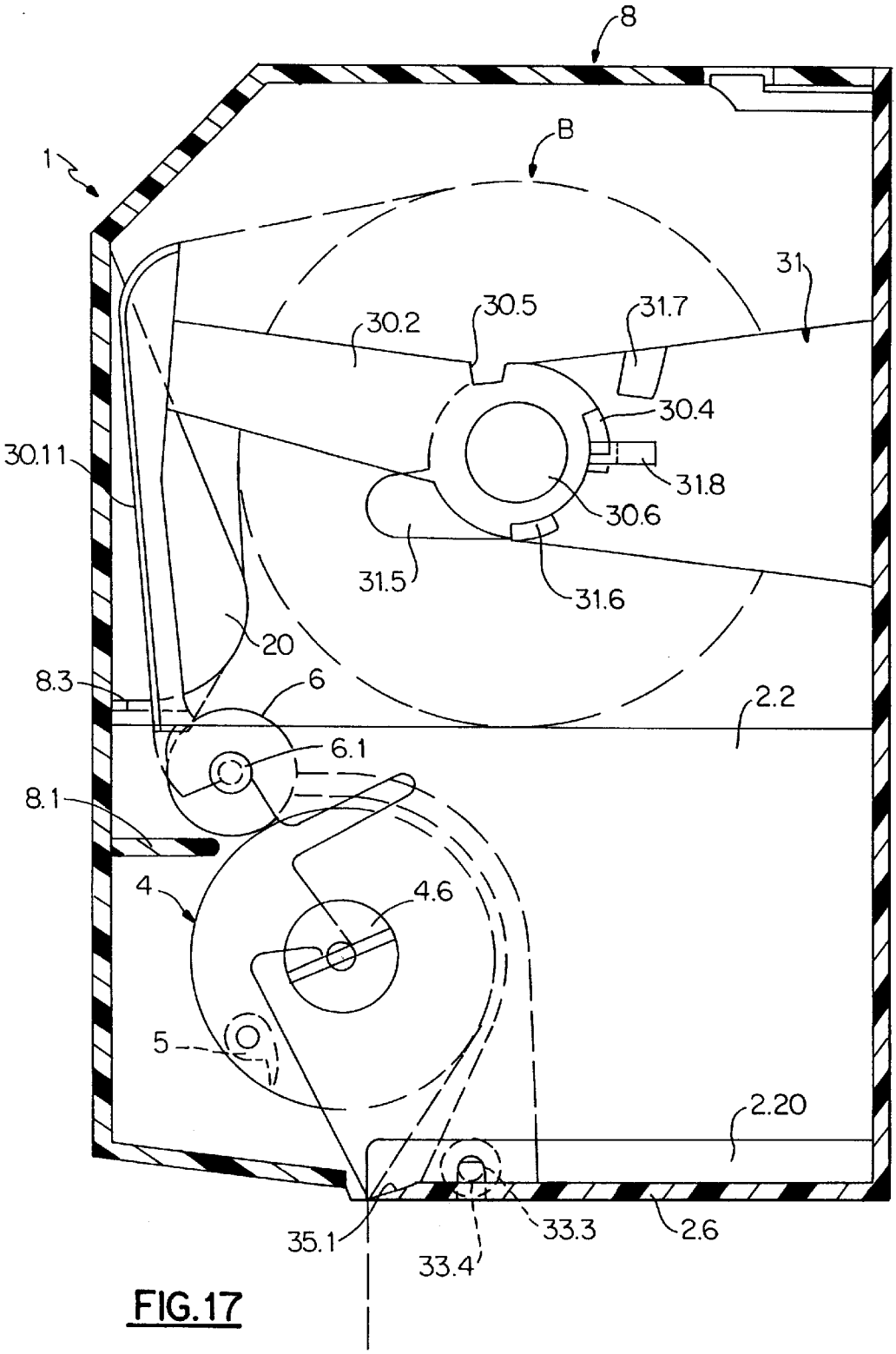
FIG. 17 is a side-face view of the apparatus according to FIG. 16.
Figure 19:
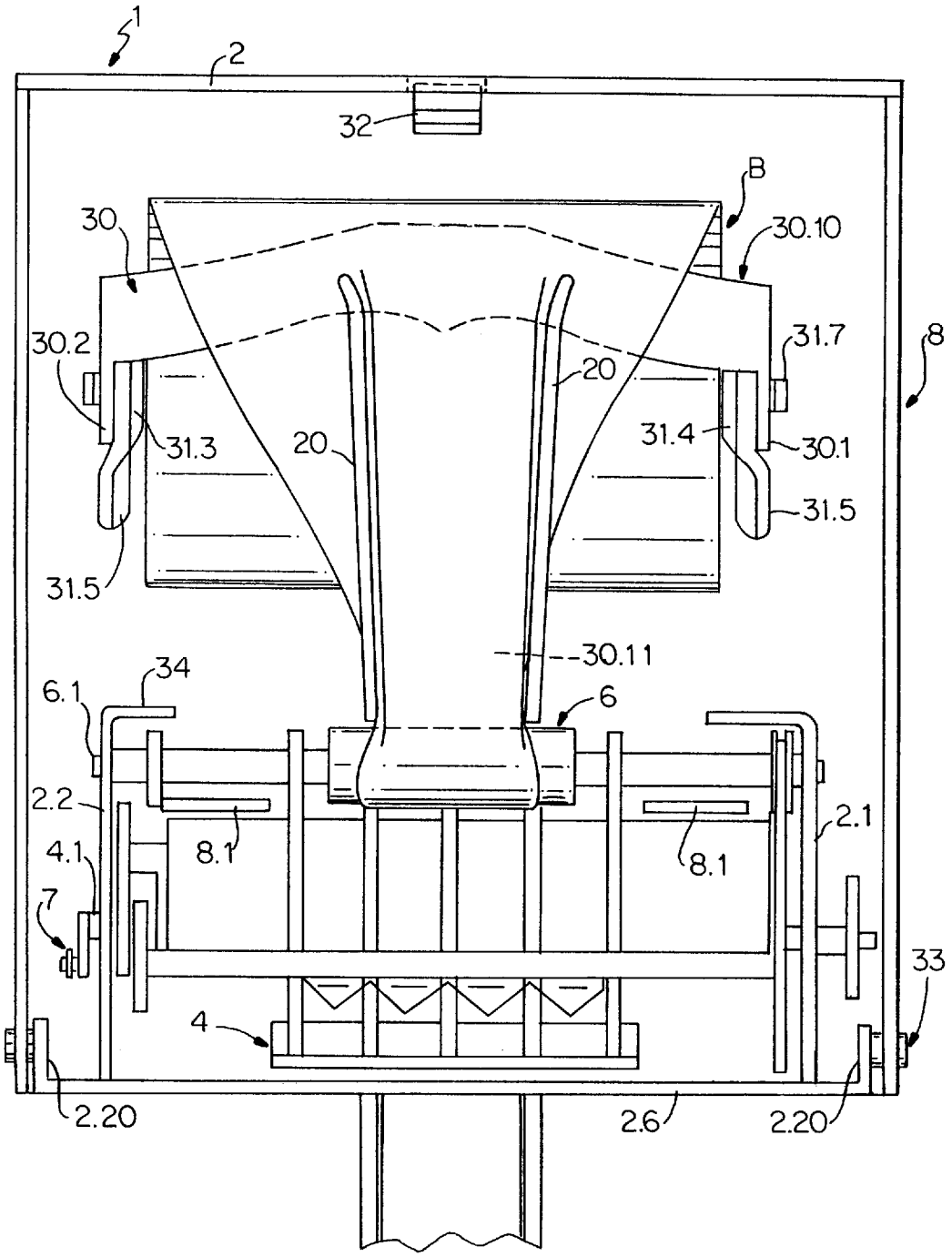
FIG. 19 is a front view showing the folding of the paper band.
Figure 20:
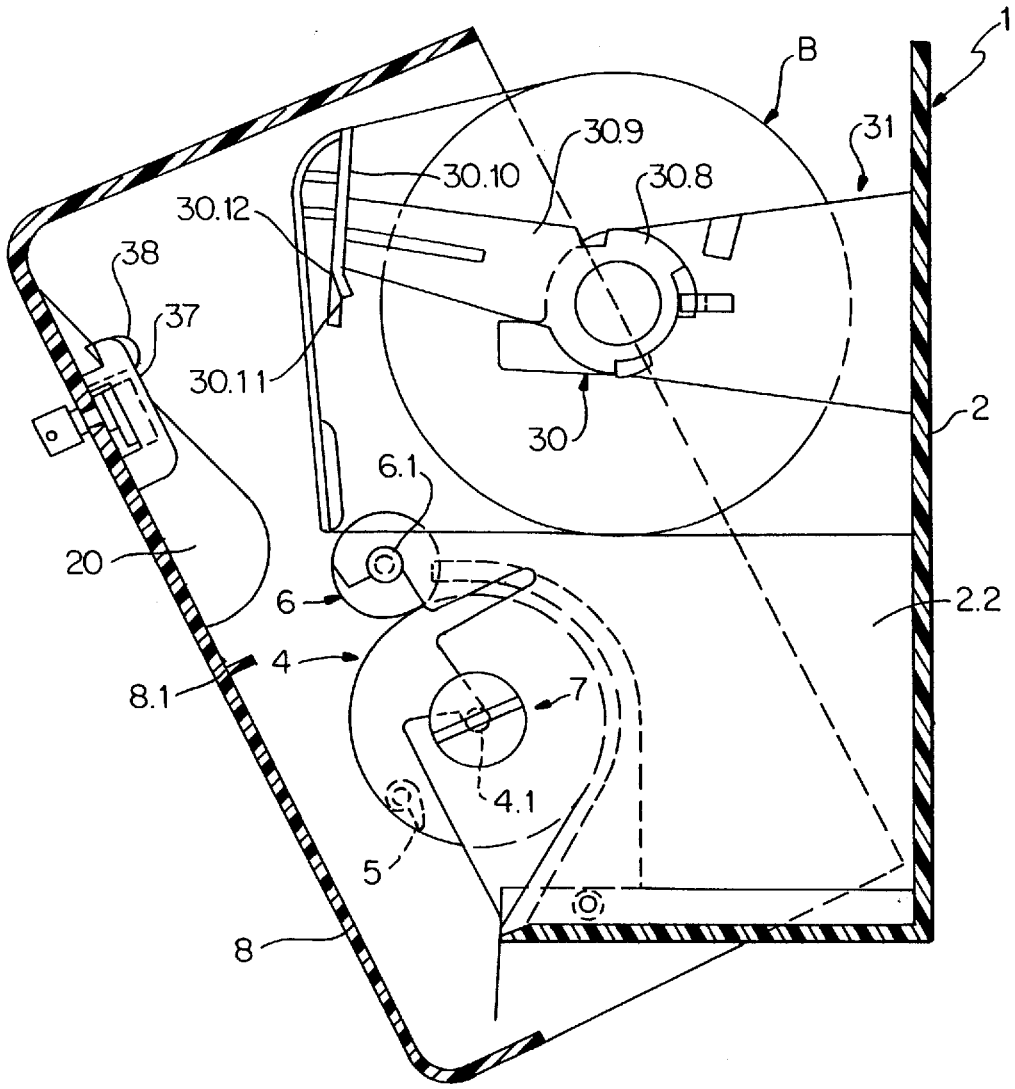
FIG. 20 is a side sectional view showing the apparatus' locking device and its operation in the schematic diagram of the different components.
Figure 21:
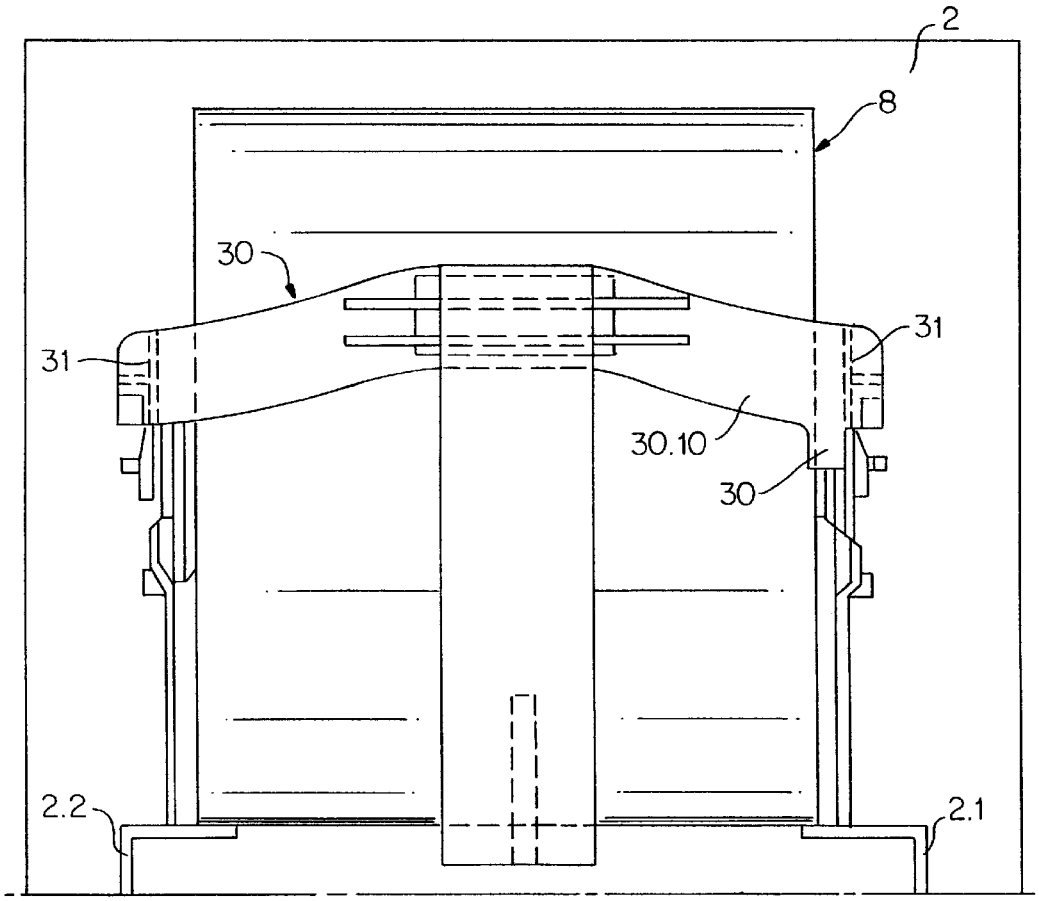
FIG. 21 is a front view of the apparatus with the cover removed showing in particular the reel-holder arm.
Figure 22:
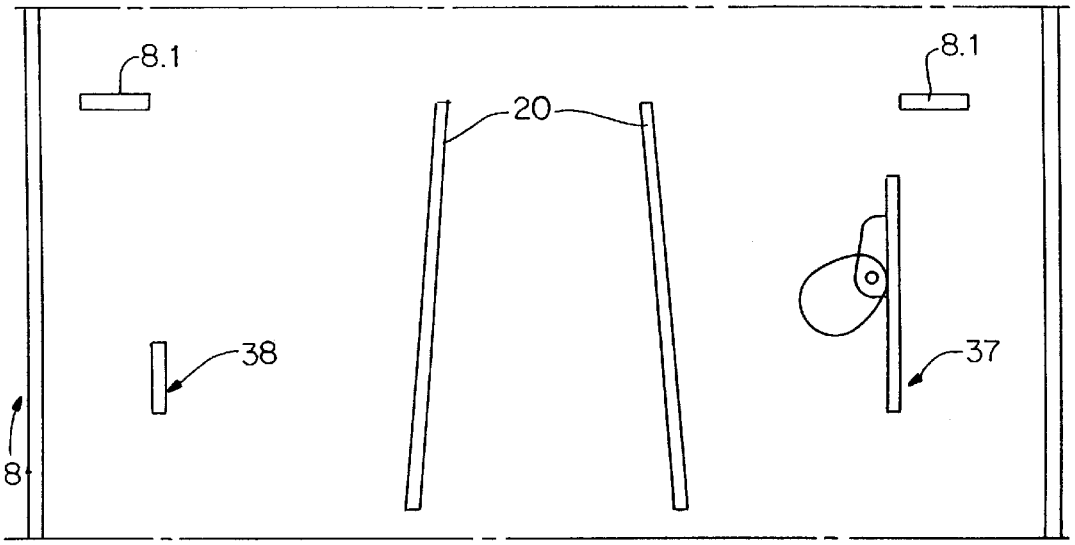
FIG. 22 is a partial plane view showing the cover and its fittings.
Figure 24:
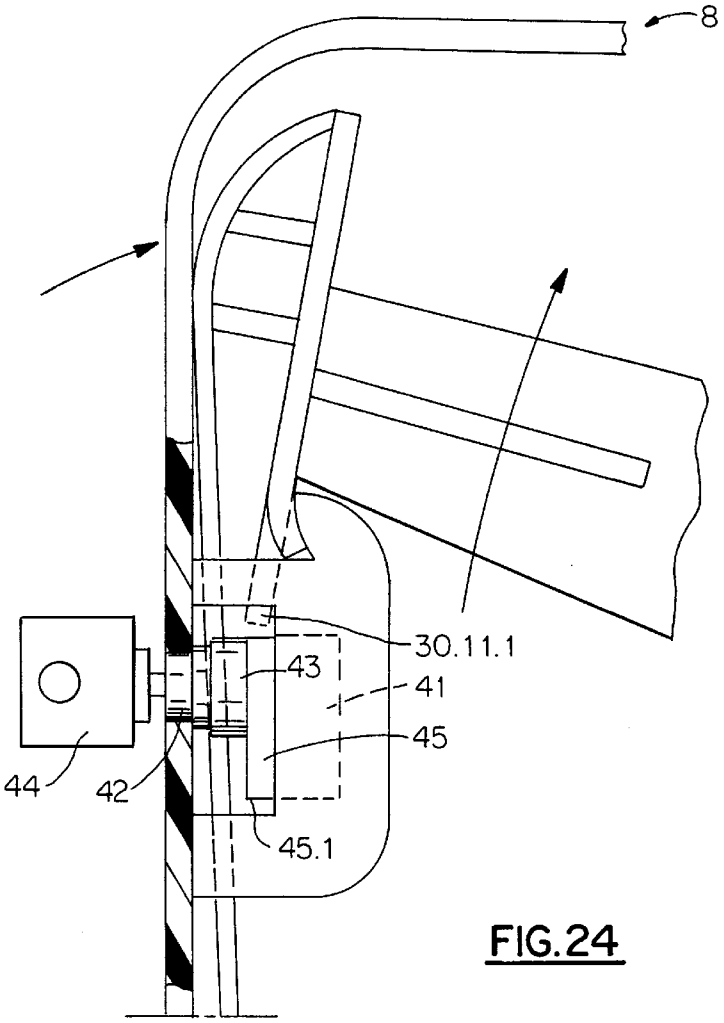
FIGS. 23 and 24 are partial side sectional views showing the cover's locking phases onto the housing at the point of the manoeuvring key ensuring locking.
Figure 23:
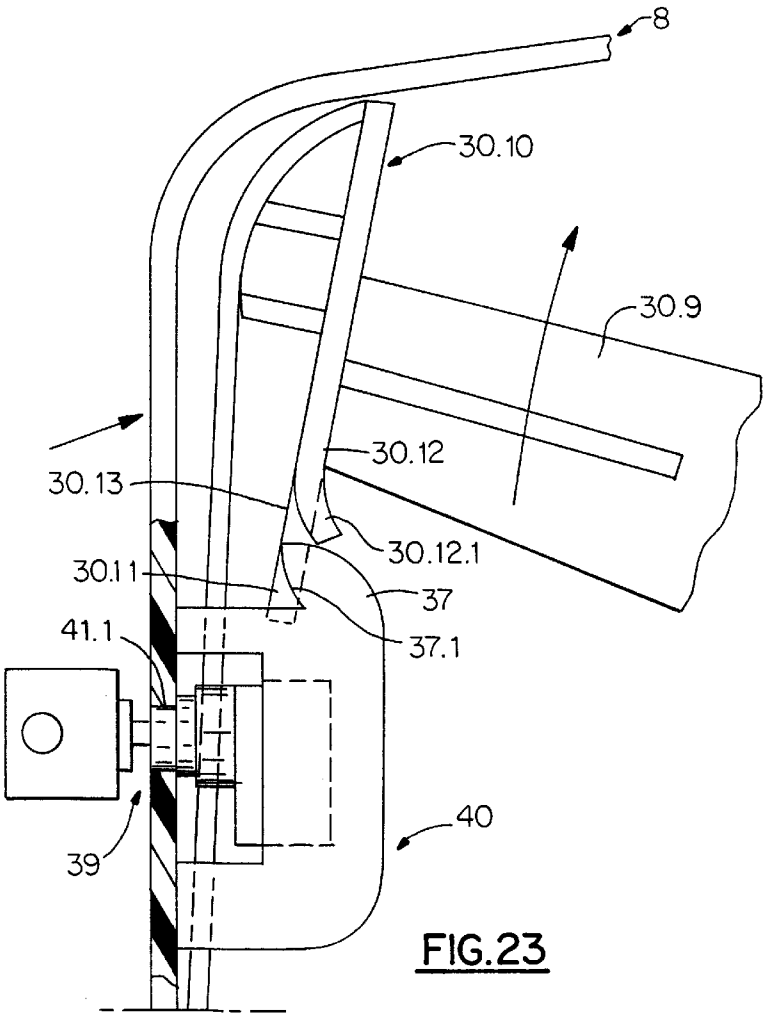
Figure 26:
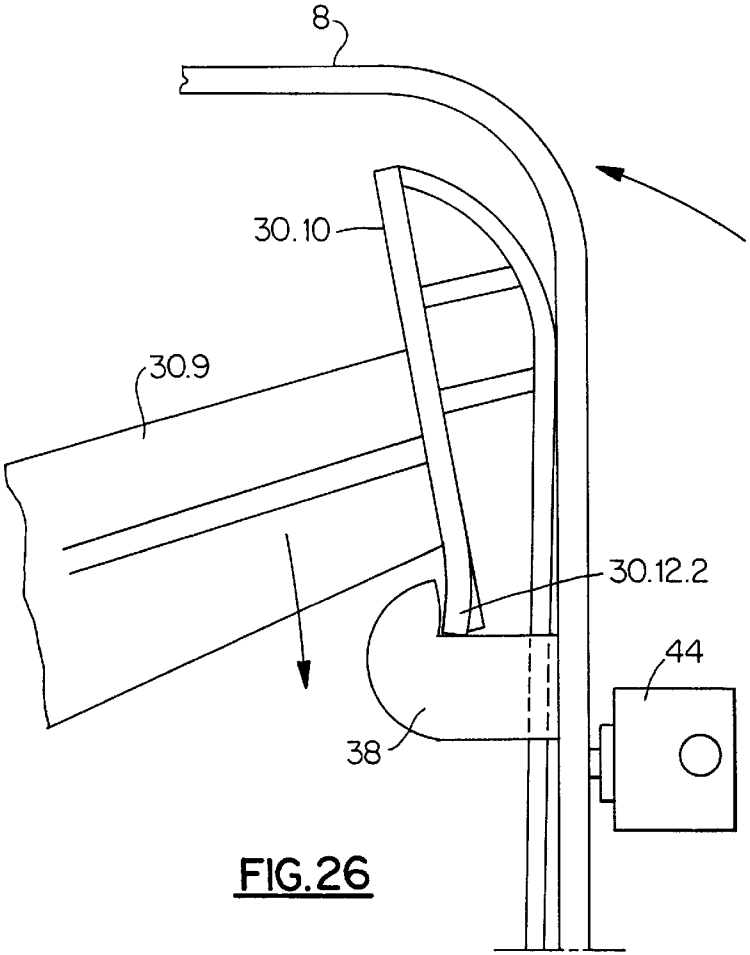
FIGS. 25 and 26 are partial sectional views showing the locking of the reel-holder arm at the point opposite the manoeuvring key.
Figure 25:
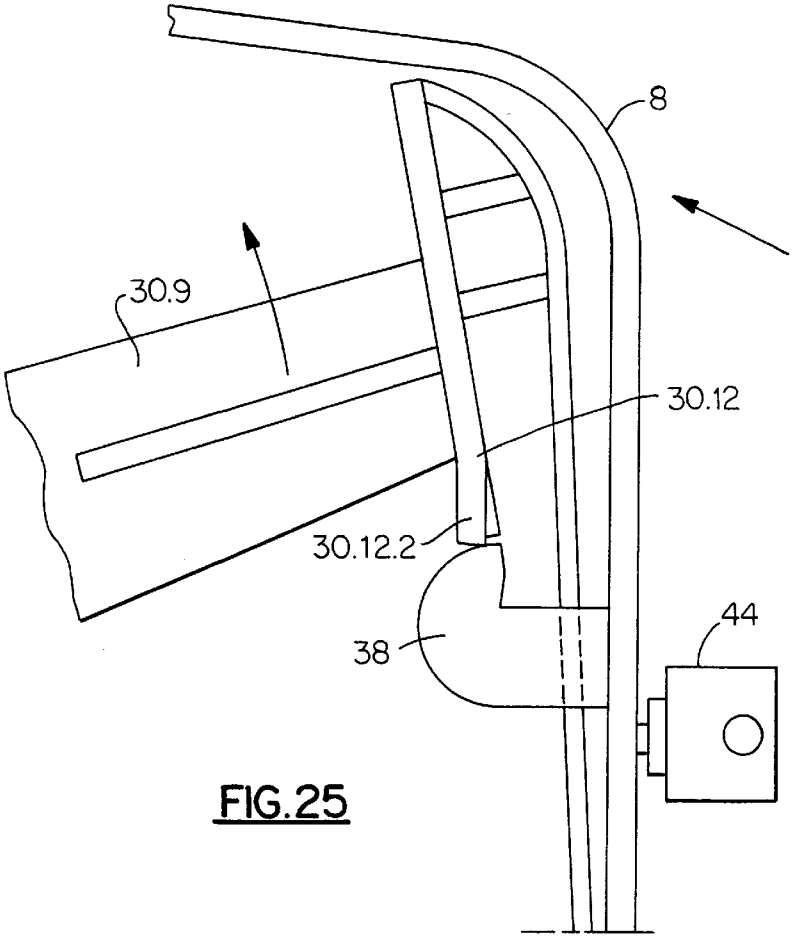
Figure 27:
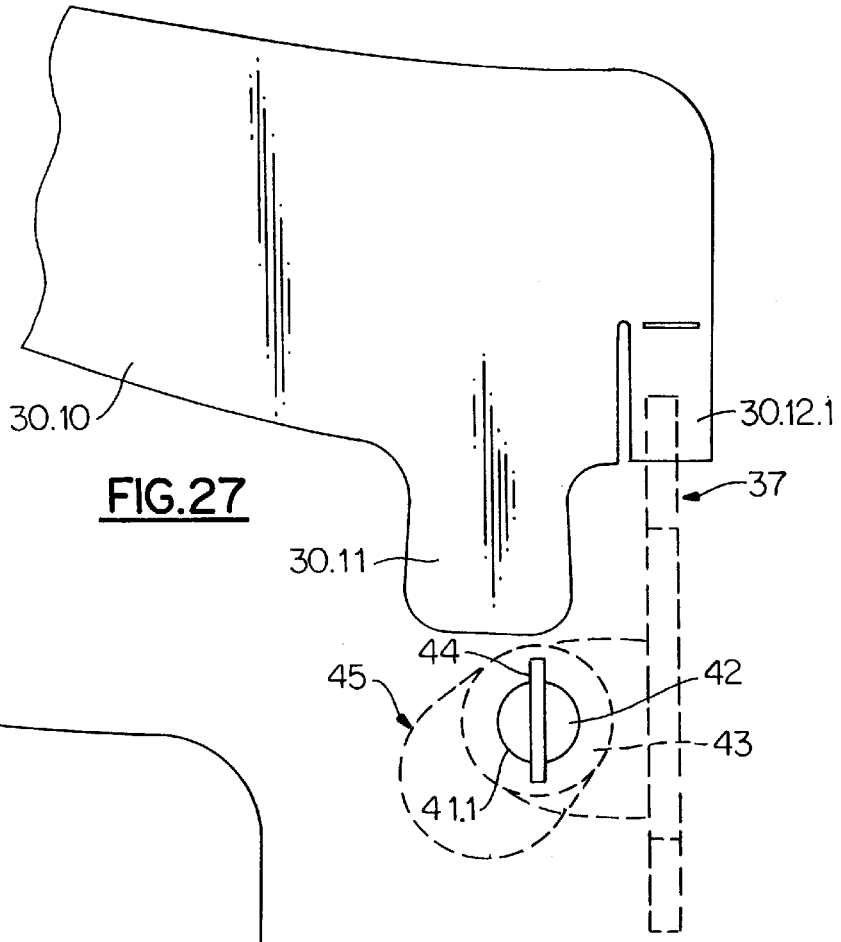
FIGS. 27 and 28 are sketches showing the ways of lifting the reel-holder arm in order to unlock the cover relative to the housing.
Figure 28:
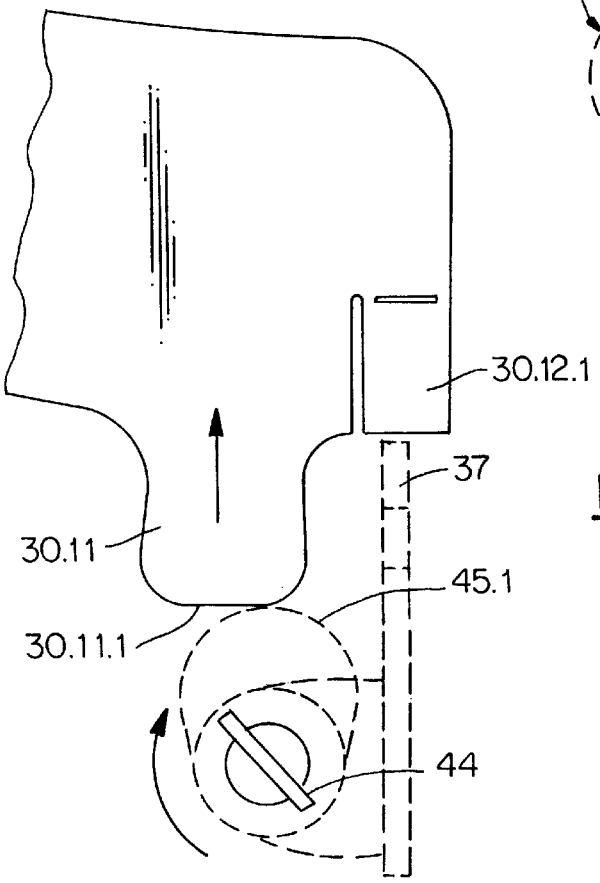

The ends of the sides of the arch therefore have a general rounded external shape (30.7) which extends towards the forward part in a straight area (30.9) with a crosswise connecting plate (30.10) that links the two sides. When the arch is raised as shown in FIGS. 14 and 15, the lateral sides are in a vertical plane and the rounded part (30.7) of said sides is moved away from the opposite lateral flanges by the removal effect created by their contact with cam (31.6) formed on flanges (31). In this situation, end piece (30.3) formed internally on each side of the arch is in a retracted position inside circular opening (31.2) made on the lateral flanges of the housing thus leaving free passage so that the reel of material can be inserted. In this situation, the upper edge (30.9.1) of the straight connecting parts of the sides of the arch comes into contact with the upper limit stop formed on each of the lateral flanges. The rectangular scalloping formed on the sides of the arch is essentially above the hook shape on the flanges of the housing.

Such an arrangement allows easy engagement of a reel of material.

The arch is lowered by a manual action, for example, and this movement will allow, by angular swivelling, gradual escape of the ends of the sides of the arch relative to the lateral flanges and, particularly, of the cam by gradually eliminating the effect of the latter. As the arch is gradually lowered, the lateral sides (30.1) of the arch move closer to lateral flanges (31) of the housing until there is complete escape from cam (31.6) thus permitting the exit of end pieces (30.3) from inside the lateral flanges of the housing, these end pieces penetrating into the spindle that supports the reel of material. In the maximum lowered position of the arch, the bulge (30.4) formed externally on the sides of the arch is in the area of the hook made on the lateral flanges and prevents, thanks to its thickness, lateral displacement of the arch. Simultaneously, the lateral connecting parts of the latter come into contact with the end tabs (31.5) of the lateral flanges thus contributing towards the greater stability of the assembly. The reel of material is self-locked and only raising of the arch makes it possible to release it by retracting the end pieces (30.3). Only lowering of the arch makes it possible to secure and hold in place the reel of material by locking it in position. The pulled paper band intended to be inserted between the reel and the tensioning device is offset from the arch.

Fitting the arch on the housing of the apparatus necessitates positioning the part that forms a hook on the lateral flanges opposite the scalloping on the sides of the arch. Said sides are then moved apart slightly manually in the limit stop area (31.7) on the lateral flanges. When positioning the hooks and scalloping opposite each other, moving the sides apart makes it possible to remove the arch. Conversely, fitting is obtained under the same conditions and moving the lateral sides from the limit stops allows self-locking of the arch because the rectangular scalloping is no longer opposite the hooks.

Very advantageously, the arch has at its front a profiled arm (30.11) which is in a vertical position when the arch is lowered so that it is opposite the tensioning device. This arrangement therefore makes it possible to use the arch in order to format the paper band so that it can be folded under conditions referred to above. The paper band from the reel of material passes over the arch and in front of the arm so that it can then be folded under the conditions described in above-mentioned patent, vertical projections (20) cooperating with the arm in order to ensure folding.

Incidentally, during raising of the arch, the arm may self-lock underneath tongue (32) which locks and connects the cover with the housing.

According to another characteristic of the invention, the cover (8) is fitted on housing (2) as follows: in the lower part of the housing on its sides or vertical flaps (2.20) there is provision to form, at the time of moulding, studs (33) having two disc shapes (33.1, 33.2) linked to each other by a shaft (33.3) having two parallel flats (33.4). The lower part of the cover has cutouts (8.4) with a straight slot (8.5) having a circular end shape (8.6) of larger diameter. Fitting the cover is obtained after offering up the latter to fit it and being guided by the flat parts (33.4) of the shafts of the studs and after coming into contact with the bottom in the circular openings (8.6) of the cover. After fitting, the cover is self-locked relative to the housing unless the flat parts of the shaft of the studs opposite each other are positioned opposite the straight part of the slits formed in the lower cutouts of the cover.

Such an arrangement therefore provides additional security.

According to another characteristic of the invention, the upper part of the flanges that support the drum and the tensioning device is made with an essentially upward curved shape (34) in the direction of the lateral flanges that cooperates with the arch that supports the reel of material so that it can be manually guided into the position in which it is fitted.

According to another characteristic, on the bottom surface of the housing at the outlet of the paper, there is a bulged area (35) which prevents the hand being inserted by presenting a sloping internal wall (35.1) in order to facilitate the transport and guiding of the paper.

According to another characteristic, behind the drum there is provision to place a bow (36) comprising a shaped tip (36.1) that penetrates into a central slot on tensioning device (6), said bow having at its sides shaped curved walls (36.2) opposite the drum to facilitate transport of the paper. This bow and curved walls are premoulded on the housing.

The apparatus as described can be used to dispense paper in both an unfolded and a folded version regardless of the lowered position of the arch. If the apparatus works by dispensing unfolded paper, the paper band passes behind the arm of the arch without being obstructed and is guided by projections (20) formed on the cover. The paper band is therefore then guided between the drum and the tensioning device by the effect of horizontal projection (8.1). Assuming that the arch does not have a vertical arm, it is fitted in the same way. Assuming the apparatus works to dispense folded paper, the paper band passes in front of the arch and the arm in question.

Reference is now made to the apparatus' improved locking device.

It should be remembered that the U-shaped arch (30), has lateral arms (30.1, 30.2) surrounding the outside of the flanges of the apparatus' housing.

The sides of the arch therefore have a general rounded external shape (30.8) and extend towards the forward part in a straight area (30.9) with a crosswise connecting plate (30.10) that links the two sides.

According to the original shape of this device, the connecting plate (30.10) of the reel-holder arm is fitted, at one of its ends, with a lug (30.11) directed downwards and rectangular in shape for example with rounded angles. Said connecting plate extends, in its axial plane, by parts (30.12) arranged externally of the lateral arms (30.1–30.2) of the arch and in particular have a tapered straight zone (30.13) which can constitute a contact zone with hooking means (37 and 38) arranged on the cover (8) of the apparatus. On the cover, a key system which is designed in its whole by (39) is arranged and fixed in an appropriate manner opposite the end of the arch (30) and the lug (30.11). The key system is therefore opposite the apparatus' opening. This particular key system has one part (40) which is mounted or obtained directly by moulding during the manufacture of the cover firstly with a hook shape (37), and with, in the plane parallel to the plane of the cover, a support (41) which is designed to have a thread or bore (41.1) to allow the passing and fitting of a shaft (42) corresponding to lock (43) of key (44). Said lock arranged internally between the aforementioned support (41) and the cover's internal wall receives a cam shape (45) hinge-mounted on the shaft (42) when the key is turned. This oblong-shaped cam (45) is designed, with its edge (45.1) to come into contact with edge (30.111) corresponding to the lug (30.11) formed on the arch, in the conditions which will be later detailed. The hook shape (37) directed upwards is designed to cooperate with and click into corresponding part (30.121) of the end extension formed on the arch's connecting plate. For this purpose, hook shape (37) has a curved shape (37.1) also forming a ramp and which can proceed to lift the arch. After engagement and installation, said part forming a hook (37) is behind the arch's connecting plate (30.10) and in particular its extension (30.12).

Parallely and in order to ensure stability and avoid any undesirable deformation of the arch and of the cover by elastic deformation, another and second hook shape (38) has been provided for on the cover, arranged essentially in the same plane, but on the other side of the middle arm arranged on the arch in order to cooperate with and ensure the locking in position of the arch, the hook part is therefore behind the end part (30.12.2) of the arch's connecting plate (30.10).

The cover (8) is unlocked relative to the housing by moving the manoeuvring key and by rotating the cam-shaped part (45) which then comes into contact with the lug (30.11) formed on the arch, thus causing the latter to be raised and freeing the ends (30.12) of the connecting plate relative to the hook parts (37–38) arranged on the cover.

Once the arch has been raised, the cover (8) opens by gravitational forces, enabling access to the apparatus' various mechanisms.

This locking arrangement can be used in different paper band operating and dispensing arrangements, either in folded or unfolded form as, in this latter case, deformation of the folded band at the point of the arm connected to the reel-holder arch leaves the lug (30.11) exposed and the end lugs (30.12) of the connecting plate for the different locking and unlocking functions referred to above.

According to a complementary arrangement, the shape of the hook (37) connected to the locking mechanism is essentially protruding (37.2) in order to enable by clipping an improved holding effect on the arch. The shape of the second hook (38) remains straight and serves uniquely to retain the end part of the reel-holder arch's connecting plate.

According to another arrangement, the arm part connected to the connecting plate and acting at the folding of the paper band fold is designed to rest against the inner wall of the cover when this nears the housing when being closed. The cover's wall can, when pivoted, contribute towards the raising of the arch by thus ensuring a complementary hold on the reel-holder arch.

Figure 29:
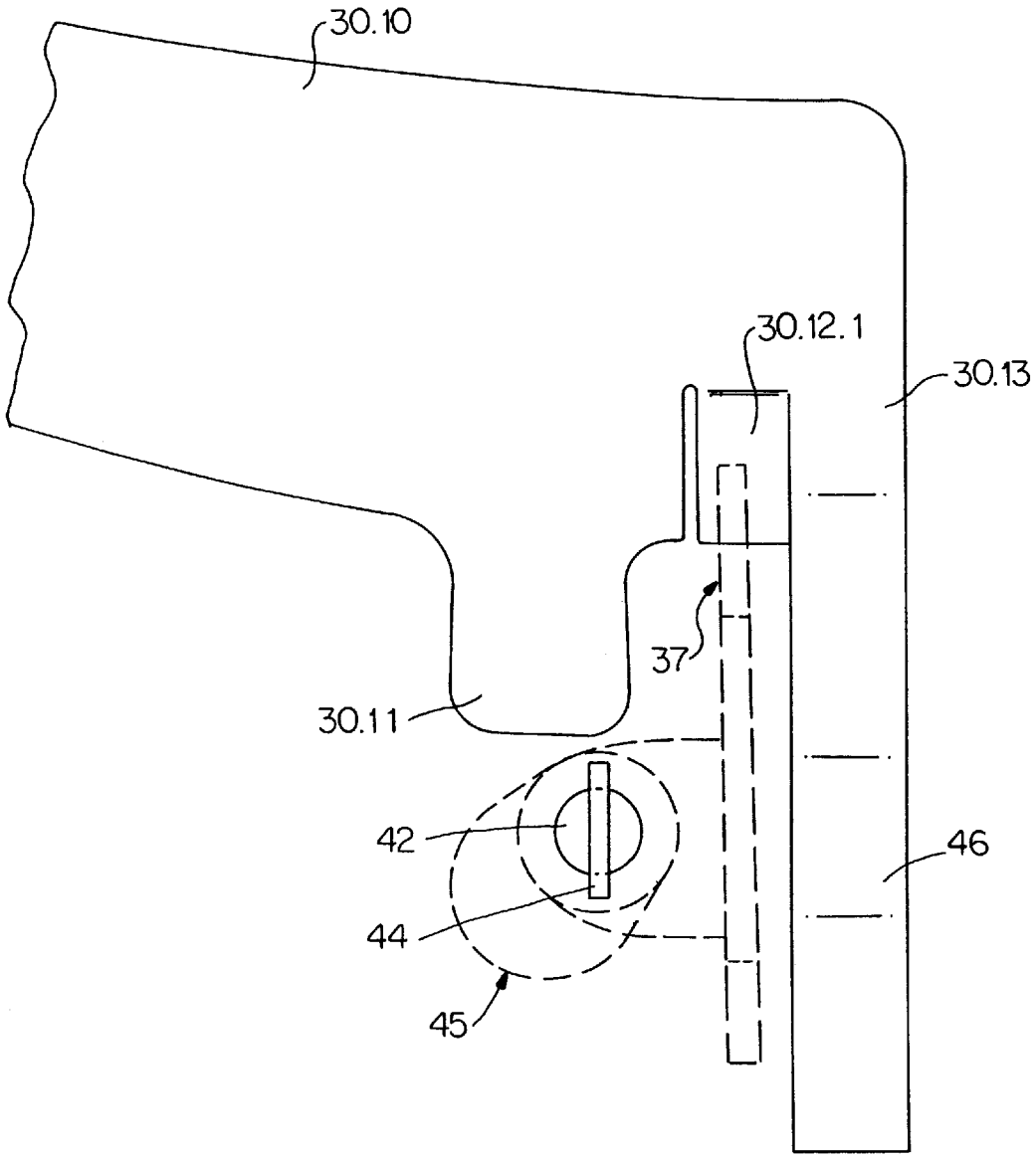
FIG. 29 is a view of another embodiment of the reel-holder arm.

In a varying embodiment shown in FIG. 29, connecting plate (30.10) extends beyond lugs (30.11) by extensions (30.10) on which parts (46) are added forming shaped springs and having a resilience when coming into contact with the cover's inner wall, and therefore acting in the same conditions as the arch arm in the previous embodiment.

The invention's advantages are obvious, most notably the improved quality of the apparatus'locking mechanism as the reel-holder is held in a locked position while stabilising the reel, while according to the prior art the locking key only ensured a link between the cover and the housing.

The invention's implementation is simple and not expensive as the various improvements and components can be designed while moulding the apparatus' essential parts, such as the cover and the reel-holder. Furthermore, as the lock is in a frontal position, the user has better access to it, making it easier to load the apparatus with paper.

Another advantage lies in the fact that the lock is arranged inside the apparatus in such a way that, when the key is removed, the cover's front external wall has no protruding surface.

It is also emphasised that locking is performed in two areas by hooks (37 and 38) which are arranged laterally and at the ends of the arch.

I claim:

1. A paper dispenser comprising lateral flanges inside an upper part of a housing to support a reel of paper material and, inside a lower part of the housing, a drum designed to be fitted with a cutoff device, a tensioning device pressing onto said drum, with a paper band running from said reel of paper material along a paper path between said drum and said cutoff device, said cutoff device being hingably mounted relative to the drum to ensure a paper length pulled out by a user is cut according to a cycle that is determined by drum rotation and including means to start and reverse the rotation of said drum as well as a hinged cover located at the bottom of the housing and clicked in place with a locking device, a controlled-stroke hinged device mounted onto said lateral flanges and in that said cover includes a plurality of longitudinal ribs fitting said controlled-stroke hinged device such, that when the cover is closed and the device lowered in a first position, the length of paper the user pulls on is folded with the long ends partly under the band fed out by an upper part of the hinged device so that it may be introduced folded between the drum and the tensioning device, be severed by the cutoff device, folded and be pulled out as a folded napkin by the user, and in that said hinged device, when moved into a second raised position relative to the lateral flanges inside said housing and the assembly consisting of the drum and the tensioning device, will allow the paper to be fed unfolded between the drum and the tensioning device and severed by the cutoff device when pulled onto by the user.

2. Apparatus as claimed in claim 1, wherein the controlled-stroke hinged device is a U-shaped arch having two sides sized to be fitted on the outside of a pair of support flanges supporting the reel of material, the inside of each side featuring a sleeve to fit a spindle (M) of the reel of material, said sides being linked by an extruded crosswise connecting plate with a rounded upper shape, said plate a long, extruded arm, which, when the controlled-stroke hinged device pivots, comes to rest on a side of the tensioning device, and in that the width of said arm is such as to accommodate ribs molded into the cover, leaving a passage for positioning, inserting and feeding through a folded paper band.

3. Apparatus as claimed in claim 2, wherein the end parts of said sides have rounded corners continuing in straight edges designed to be arrested by a lower stop integral with the outside of the lateral flanges.

4. Apparatus as claimed in claim 2, wherein the sides feature a notch formed along the edge in the upper part of the side, said notch cooperating with a hook formed on the outer part of the reel supporting flange, said hook having an opening allowing the side to pass through its width and, after engagement, the locking device to pivot without displacement, unless a notch of said housing and hook of said locking device are engaged.

5. Apparatus as claimed in claim 2, wherein upper and lower stops are each arranged on the outside of the lateral flanges, in the pivoting path of the controlled-stroke hinged device, an upper stop in the upward direction, and a lower stop in the downward direction.

6. Apparatus as claimed in claim 2, wherein the controlled-stroke hinged device comprises a long arm with a flat top having a rounded connecting shape, fixed to a crosswise connecting plate, a lower part of said arm featuring a central rib, an end of said rib fitting into a central slot formed on the tensioning device.

7. Apparatus as claimed in claim 6, the rounded shape of said long arm facilitates unreeling a paper band from the reel of material and lifts the band over the crosswise connecting plate, rendering folding possible.

8. Apparatus as claimed in claim 2, wherein the cover is fitted, on a front internal surface, with two locking means designed to cooperated with means arranged on the connecting plate of the arch, enabling the cover to be locked and unlocked in position relative to the apparatus' housing.

9. Apparatus as claimed in claim 8, wherein the cover receives, in a frontal plane, a key system consisting of a hook shape arranged and shaped on the cover's inner wall, and receiving a cam-shaped support hinge-mounted on a shaft and which is designed to cooperate with a profiled lug arranged on the connecting plate of the arch, and in that hook shape has a curved shape acting as a ramp to cooperate with end part arranged in the axial plane of said connecting plate.

10. Apparatus as claimed in claim 8, wherein the cover receives on an inner wall thereof, a second hook shape designed to cooperate with an end part arranged on the arch's connecting plate.

11. Apparatus as claimed in claim 8, wherein the arm part connected to the connecting plate and acting at the folding of the paper band fold is designed to rest against the inner wall of the cover when the cover nears the housing when being closed, said inner wall helping to raise the arch by ensuring an additional hold on said arch.

12. Apparatus as claimed in claim 8, wherein the connecting plate is connected above its end parts with extensions, each extension receiving a part acting as shaped springs and having a resilience when resting against a front inner wall of the front cover.

13. Apparatus as claimed in claim 1 wherein the extruded ribs formed on the cover have rounded edges for guiding a paper band from said reel of material prior to folding when the device controlled-stroke hinged is lowered to said first position and taking up the slack of the paper band when the device is raised to the second position.

14. Apparatus as claimed in claim 1, wherein the middle part of the tensioning device features two smooth areas fully pressing down onto the folded paper band, said tensioning device having a slot in the middle for the end of the arm of the controlled-stroke hinged device and an upper end of a central bow molded onto the housing to engage in to guide the paper band.

15. Apparatus as claimed in claim 14, wherein a height dimension of the ribs at their widest point near the rounded parts is greater than the width of fold-in sides of the paper band being folded.

16. Apparatus as claimed in claim 1, wherein the protective housing comprises parallel flanges perpendicular to a housing back wall for the drum and the tensioning device to be clicked into place, said parallel flanges being equipped with tongues having a capacity for elastic deformation owing to preformed slots in the flanges, said tongues acting as housings for the tensioning device, the flanges also featuring notches into which drum shaft ends are located, and in that the recesses of each of the tensioning device and drum shaft end face one another, and in that the elastically deformable tongues holding the tensioning device, press the tensioning device onto the while causing the drum tensioning device to be self-locked in the housing of the apparatus, wherein access to the tensioning device and drum is entirely free owing to cutouts provided in the front of said tongues and parallel flanges, thereby ensuring rapid installation of apparatus components.

17. Apparatus as claimed in claim 16, wherein one of the parallel flanges of the housing is equipped with a profiled cutout in the shape of an oblique T, with the leg of the T being long and slanted upward and back, thus creating the shape of the upper tongue, the top end of the T-bar being an internal recess for one of the tensioning device shaft ends, whereas the lower part of the T-bar is a rounded notch for supporting one of the drum shaft ends, and in that a lower portion of the other parallel flange of the housing features an opening to lodge the other shaft end, around which opening is provided a part acting both as a journal and a rack to drive the drum, the upper part of the other flange being a tongue with a shaft recess separated by a slot rendering it flexible, said tongues being thus formed in the flanges having the same shape, profile and location, together forming a hook shape for the tensioning device shaft ends to be fitted into, said tongues being ramp-shaped against which the tensioning device is placed during installation.

18. Apparatus as claimed in claim 16, wherein the drum is equipped beyond one of its end discs with a groove located between a portion shaped as an eccentric and an extension shaped as a disk constituting a button for use in loading the apparatus, said groove being used to attach one of the ends of a release spring used to start the drum turning.

19. Apparatus as claimed in claim 1, wherein said controlled-stroke hinged device is hinged relative to upper flanges of the housing, said flanges being made with a circular opening and a concentric spacer ring and means of limit stopping and guiding, and in that said controlled-stroke hinged device is made in the form of a U-shaped arch having lateral arms which surround the outside of the upper flanges of the housing, and in that said lateral arms have end pieces capable of fitting in the circular openings and spacer rings on the flanges of the housing, and in that the movement of lowering or raising the arch makes it possible to retract said end pieces or allow their offset inside the volume defined between the flanges in order to allow their insertion and self-locking in position of the reel of material, and in that the sides of the arch and the lateral flanges are designed with means for allowing displacement of said end pieces by relative modification of the position of the lateral arm relative to the upper flanges of the housing.

20. Apparatus as claimed in claim 19, wherein the flanges of the housing include a circular opening that extends internally with a spacer ring that has, towards its periphery, a flared face, said walls extending forward in a tongue pointing towards the outside of the apparatus and in that the outside surface of the flanges is made with a cam forming a ramp that temporarily cooperates with the lateral arms opposite the arch during swivelling of the arch when it is raised or lowered.

21. Apparatus as claimed in claim 20, wherein the cam is arranged in a lower part of the lateral flanges of said housing and in that on the same side as said cam there is an angularly directed limit stop to allow positioning of the arch in its raised position, a hook shape being arranged between the cam and the limit stop to constitute means of locking the arch after fitting, said hook shape having an internal recess allowing free passage and hinging of the arms of the arch.

22. Apparatus as claimed in claim 20, wherein the ends of the arms are designed with a bulge which adapts and positions itself in the hook shapes of the lateral flanges of the controlled-stroke hinged device during certain positioning phases of the arch and prevents lateral displacement of said arch.

23. Apparatus as claimed in claim 22, wherein the ends of the arms of the arch include rectangular scalloping that can be aligned opposite the hook shapes and in that in a position that is essentially diametral to the scalloping there is a recess over a limited angular sector of the periphery of the arm of the arch, defining a limit-stop surface that cooperates with the cam.

24. Apparatus as claimed in claim 20, wherein the tongues formed on the flanges of the controlled-stroke hinged device constitute means of stopping and limit stopping during swivelling and lowering of the arch and act as a support for lateral sides of the arch.

25. Apparatus as claimed in claim 19, wherein the arch has a crosswise connecting plate between its lateral sides which extends downwards by means of a profiled side opposite the tensioning device.

26. Apparatus as claimed in claim 19, wherein the lower part of the housing has vertical flaps allowing the positioning of studs consisting of two disc shapes linked to each other by a connecting shaft, said shaft having two flats in order to allow engagement and locking in position of the cover, the cover having, in a lower part, cutouts with a straight slot having a circular shaped end of larger diameter.

27. Apparatus as claimed in claim 19, wherein the upper part of the flanges that support the drum and the tensioning device is made with an essentially upward curved shape in the direction of the lateral flanges.

28. Apparatus as claimed in claim 19, characterised in that the application for dispensing unfolded paper, wherein the paper band is routed from the reel to the space between the drum and the tensioning device and passes behind the arch.

29. Apparatus as claimed in claim 19, characterised in that in the application for dispensing folded paper, wherein the paper band is routed from the reel to the space between the drum and the tensioning device and passes in front of the arm of the arch.

30. Apparatus as claimed in claim 19, wherein the paper band is routed from the reel to the space between the drum and the tensioning device and passes behind the arch.

31. Apparatus as claimed in claim 1, including a folded paper napkin dispensed by said apparatus in which the long ends of the paper band being partially folded under the top of the band forms fold-in sides.

32. Apparatus as claimed in claim 31, wherein the edges of the paper band are greater than the width of the upper part of the folded paper napkin of the paper band.

* * * * *

UNITED STATES PATENT AND TRADEMARK OFFICE

CERTIFICATE OF CORRECTION

PATENT NO. : 5,836,862

DATED : November 17, 1998

INVENTOR(S) : Maurice Granger

It is certified that error appears in the above-identified patent and that said Letters Patent is hereby corrected as shown below:

CLAIMS:

Col. 13, Line 2, claim 2. in the content please delete "(M)".

Col. 16, Line 39, claim 32. in the content please delete "of the paper band".

Signed and Sealed this

Thirtieth Day of March, 1999

*Attest:*

*Attesting Officer*

Q. TODD DICKINSON

*Acting Commissioner of Patents and Trademarks*